US011523681B2

(12) United States Patent
Chen

(10) Patent No.: US 11,523,681 B2
(45) Date of Patent: Dec. 13, 2022

(54) FRAME AND TABLE HAVING STRUCTURE FOR REDUCING VIBRATION

(71) Applicant: Inno-Sports Co., Ltd., Xiamen (CN)

(72) Inventor: Renhua Chen, Xiamen (CN)

(73) Assignee: Inno-Sports Co., Ltd., Xiamen (CN)

( * ) Notice: Subject to any disclaimer, the term of this patent is extended or adjusted under 35 U.S.C. 154(b) by 0 days.

(21) Appl. No.: 17/095,207

(22) Filed: Nov. 11, 2020

(65) Prior Publication Data

US 2021/0169215 A1 Jun. 10, 2021

(30) Foreign Application Priority Data

Dec. 9, 2019 (CN) ..... 201922188687.7
Dec. 9, 2019 (CN) ..... 201922188736.7
Dec. 9, 2019 (CN) ..... 201922188737.1
Dec. 9, 2019 (CN) ..... 201922188740.3

(51) Int. Cl.
*A47B 3/091* (2006.01)
*A47B 3/08* (2006.01)

(52) U.S. Cl.
CPC ..... *A47B 3/0915* (2013.01); *A47B 3/0809* (2013.01)

(58) Field of Classification Search
CPC ..... A47B 3/0915; A47B 3/0809
USPC ..... 108/130
See application file for complete search history.

(56) References Cited

U.S. PATENT DOCUMENTS 1,063,642 A 6/1913 Birdsell
1,742,699 A * 1/1930 Fellows ..... E05D 11/087 16/340
2,136,569 A 11/1938 Trimpi
2,803,033 A 8/1957 Rachman
2,803,050 A 8/1957 Birger
2,868,599 A 1/1959 Roggio
3,000,049 A * 9/1961 Terry, Jr. ..... E05D 9/005 16/334
3,075,809 A 1/1963 Wilson
(Continued)

FOREIGN PATENT DOCUMENTS

CA 2971886 A1 12/2018
DE 29515948 U1 1/1996
(Continued)

OTHER PUBLICATIONS

U.S. Appl. No. 16/838,939, filed Apr. 2, 2020.
(Continued)

*Primary Examiner* — Daniel J Troy
*Assistant Examiner* — Timothy M Ayres
(74) *Attorney, Agent, or Firm* — Morgan, Lewis & Bockius LLP

(57) ABSTRACT

A table includes a table panel, first and second mounting members, and first and second leg assemblies. Each of the first and second mounting members is coupled or formed with the table panel. Each of the first and second leg assemblies includes a linking member having an end portion rotatably coupled with the first mounting member and another end portion rotatably coupled with the second mounting member. When the first or second leg assembly is unfolded, the linking member abuts one or more retainers of the table panel and forms interference fit with the first and second mounting members. This significantly reduces vibration when the table is in use.

20 Claims, 40 Drawing Sheets

(56) References Cited

U.S. PATENT DOCUMENTS 3,187,373 A 6/1965 Fisher
3,368,504 A 2/1968 Cohen
3,410,232 A 11/1968 Bills
3,410,327 A 11/1968 Ausnit
3,488,667 A * 1/1970 Gutshall ..... E05D 11/105 16/321
3,861,328 A 1/1975 Lawless
4,151,681 A * 5/1979 Roberts ..... E05D 3/04 312/321.5
4,191,111 A 3/1980 Emmert
4,285,105 A 8/1981 Kirkpatrick
4,561,108 A 12/1985 Kamp
4,734,955 A * 4/1988 Connor ..... B60J 3/0265 16/332
4,792,240 A 12/1988 Ausnit
5,284,100 A * 2/1994 Thorn ..... A47B 3/0912 248/345.1
5,325,794 A 7/1994 Hontani
5,421,272 A * 6/1995 Wilmore ..... A47B 3/087 108/115
5,483,710 A 1/1996 Chan
5,715,575 A * 2/1998 Kubota ..... H04M 1/0216 16/342
5,745,954 A 5/1998 Shogan
5,761,769 A * 6/1998 Bruckner ..... E05D 11/084 16/342
5,857,229 A 1/1999 Magnani, Jr.
5,983,807 A * 11/1999 Tarnay ..... A47B 3/0912 108/131
6,223,366 B1 5/2001 Cheng
6,349,449 B1 * 2/2002 Kuehl ..... E05D 11/084 16/342
6,363,550 B1 4/2002 Wang
6,371,034 B1 * 4/2002 Simpson ..... A47B 3/0912 108/129
6,508,262 B1 1/2003 Takayama
6,843,183 B2 1/2005 Strong
6,971,321 B1 12/2005 Strong
7,059,254 B2 6/2006 Strong et al.
7,096,799 B2 8/2006 Strong et al.
7,097,380 B2 8/2006 Lee
7,171,910 B2 2/2007 Neunzert et al.
7,260,871 B2 8/2007 Borchardt
7,428,872 B2 9/2008 Strong et al.
7,475,643 B2 1/2009 Haney et al.
7,475,644 B2 1/2009 Strong et al.
7,634,969 B2 12/2009 Neunzert et al.
7,640,870 B2 1/2010 Strong et al.
7,644,667 B2 1/2010 Strong et al.
7,735,431 B2 6/2010 Neunzert et al.
7,874,303 B2 1/2011 Xie
7,891,055 B1 * 2/2011 Combs ..... E05D 11/084 16/342
8,006,630 B2 8/2011 Strong et al.
8,033,228 B2 10/2011 Haney et al.
8,042,475 B2 10/2011 Larcom et al.
8,113,130 B2 2/2012 Leng
8,136,460 B2 * 3/2012 Tait ..... E04H 3/28 108/157.1
8,156,875 B2 4/2012 Neunzert et al.
8,302,541 B2 11/2012 Haney et al.
8,307,513 B1 * 11/2012 Fitzgerald ..... E05D 11/06 16/386
8,342,107 B2 1/2013 Mover et al.
8,534,205 B1 9/2013 Johnson et al.
8,578,865 B2 11/2013 Haney et al.
8,622,007 B2 1/2014 Peery et al.
8,746,155 B2 6/2014 Haney et al.
8,757,069 B2 6/2014 Peery et al.
8,904,943 B2 12/2014 Jin
9,027,952 B2 5/2015 Zhu
9,103,368 B2 8/2015 Mendes
D748,418 S 2/2016 Johnson et al.
9,277,808 B2 3/2016 Cai et al.
9,282,812 B2 3/2016 Chang
D756,694 S 5/2016 Johnson et al.
9,351,563 B2 5/2016 Bennett et al.
10,806,246 B1 * 10/2020 Chen ..... A47B 3/087
10,806,247 B1 * 10/2020 Chen ..... A47B 13/088
10,806,248 B1 * 10/2020 Chen ..... A47B 3/0812
2003/0089286 A1 5/2003 Wang
2005/0005826 A1 1/2005 Strong
2005/0097829 A1 5/2005 Seo
2005/0241550 A1 11/2005 Neunzert
2005/0279260 A1 12/2005 Stanford
2006/0062632 A1 3/2006 Jang
2006/0196395 A1 9/2006 Lin
2007/0079441 A1 4/2007 Chen
2008/0078310 A1 4/2008 VanNimwegen
2013/0000528 A1 1/2013 Jin
2013/0025509 A1 1/2013 Jin
2013/0233210 A1 9/2013 Jin
2014/0030012 A1 1/2014 Lee
2014/0070070 A1 3/2014 Shinoda
2014/0099155 A1 4/2014 Chen
2014/0130837 A1 5/2014 Sy-Facunda
2016/0348395 A1 12/2016 Jin
2017/0013955 A1 1/2017 Lin
2018/0153302 A1 6/2018 Jiang
2019/0150608 A1 5/2019 Johnson et al.
2019/0284831 A1 9/2019 Volin
2019/0292808 A1 9/2019 Dotterweich
2020/0029684 A1 1/2020 Jiang
2020/0359780 A1 * 11/2020 Nye ..... A47B 3/0815

FOREIGN PATENT DOCUMENTS

EP 1492432 B1 10/2016
WO WO 2013000149 A1 1/2013

OTHER PUBLICATIONS

U.S. Appl. No. 16/838,944, filed Apr. 2, 2020.
U.S. Appl. No. 16/838,947, filed Apr. 2, 2020.
U.S. Appl. No. 16/839,337, filed Apr. 3, 2020.

* cited by examiner

FRAME AND TABLE HAVING STRUCTURE FOR REDUCING VIBRATION

CROSS-REFERENCE TO RELATED APPLICATIONS

The present application claims priority to Chinese Utility Model Applications CN 201922188740.3 filed Dec. 9, 2019, CN 201922188737.1 filed Dec. 9, 2019, CN 201922188736.7 filed Dec. 9, 2019 and CN 201922188687.7 filed Dec. 9, 2019. The disclosure of each application is incorporated herein for all purposes by reference in its entirety.

FIELD OF THE INVENTION

The present invention generally relates to frames and tables and, in particular, to frames and tables having structures for reducing vibration.

BACKGROUND

Foldable tables are more and more popular these days. A typical foldable table includes a table panel, a mounting frame and leg assemblies. The mounting frame is formed with holes to rotatably connect the leg assemblies so that the leg assemblies can be folded onto the table panel. However, in many existing foldable tables, there exist gaps at the connections between the mounting frame and leg assemblies. These gaps can cause vibration and consequently make the tables unstable when in use.

Given the current state of the art, there remains a need for frames and tables that address the abovementioned issues.

The information disclosed in this Background section is provided for an understanding of the general background of the invention and is not an acknowledgement or suggestion that this information forms part of the prior art already known to a person skilled in the art.

SUMMARY OF THE INVENTION

The present disclosure provides frames and tables having structures for reducing vibration.

In various exemplary embodiments, the present disclosure provides a table including a table panel, first and second mounting members, and first and second leg assemblies. The table panel includes first and second surfaces, first, second, third and fourth edges, and a plurality of retainers protruding away from the second surface. Of the plurality of retainers, at least one first retainer is disposed adjacent to the first edge and at least one second retainer is disposed adjacent to the second edge. The first mounting member is disposed adjacent to the third edge of the table panel and the second mounting member is disposed adjacent to the fourth edge of the table panel. Each of the first and second mounting members includes a first opening adjacent to the first edge of the table panel and a second opening adjacent to the second edge of the table panel. Each of the first and second leg assemblies includes a linking member disposed adjacent to the first or second edge of the table panel. The linking member includes a first end portion, a second end portion, and an engagement portion in between. The first end portion of the linking member is rotatably coupled with the first or second opening of the first mounting member and the second end portion of the linking member is rotatably coupled with the first or second opening of the second mounting member such that the first or second leg assembly is foldable with respect to the table panel. The engagement portion abuts against the at least one first or second retainer when the first or second leg assembly is unfolded. The abutting of the engagement portion against the at least one first or second retainer pushes the first end portion toward a far portion of the first or second opening of the first mounting member and the second end portion toward a far portion of the first or second opening of the second mounting member, thereby reducing a gap between the first or second end portion of the linking member and the far portion of the first or second opening of the first or second mounting member and thus reducing vibration when the table is in use.

In an exemplary embodiment, the abutting of the engagement portion against the at least one first or second retainer pushes the first end portion toward the far portion of the first or second opening of the first mounting member and the second end portion toward the far portion of the first or second opening of the second mounting member until the first end portion abuts against the far portion of the first or second opening of the first mounting member and the second end portion abuts against the far portion of the first or second opening of the second mounting member, thereby forming interference fit between the first or second end portion of the linking member and the far portion of the first or second opening of the first or second mounting member.

In some exemplary embodiments, the gap is reduced up to about 2 millimeters, up to about 3 millimeters, up to about 4 millimeters, or up to about 5 millimeters.

In some exemplary embodiments, each of the first and second openings has a substantially circular shape.

In an exemplary embodiment, the engagement portion of the linking member has a substantially circular cross-section.

In some exemplary embodiments, cross-section-wise, the engagement portion of the linking member has a first dimension larger than a second dimension, and the first dimension abuts the at least one first or second retainer when the first or second leg assembly is unfolded.

In an exemplary embodiment, the engagement portion of the linking member has a substantially oval or oblong cross-section.

In some exemplary embodiments, each of the at least one first retainer and the at least one second retainer is formed with a recess toward the second surface of the table panel to receive, cross-section-wise, at least a portion of the engagement portion of the linking member.

In an exemplary embodiment, the recess has a bottom protruding away from the second surface of the table panel.

In some exemplary embodiments, cross-section-wise, the engagement portion of the linking member has a first dimension larger than a second dimension, and the first dimension abuts the recess when the first or second leg assembly is unfolded.

In some exemplary embodiments, each of the first and second leg assemblies is adjustable in length.

In some exemplary embodiments, the first or second leg assembly further includes first and second legs, first and second sliders, and first and second supporting members. Each of the first and second legs has an upper end portion fixedly coupled with the link member. The first slider is coupled with the first leg and slidable along a length direction of the first leg. The second slider is coupled with the second leg and slidable along a length direction of the second leg. The first supporting member has an end portion pivotally connected with the first slider and another end portion pivotally connected with the first mounting member. The second supporting member has an end portion pivotally connected with the second slider and another end portion pivotally connected with the second mounting member.

In an exemplary embodiment, the first or second leg assembly further includes a leg connecting member disposed between the first and second legs and connected with the first and second legs. Each of the first and second sliders includes a notch to couple with the leg connecting member when the first or second leg assembly is unfolded.

In some exemplary embodiments, the plurality of retainers further includes at least one third retainer and at least one fourth retainer. The at least one third retainer is configured to receive cross-section-wise at least a portion of the first or second leg of the first leg assembly when the first leg assembly is folded. The at least one fourth retainer is configured to receive cross-section-wise at least a portion of the first or second leg of the second leg assembly when the second leg assembly is folded.

In various exemplary embodiments, the present disclosure provides a supporting frame including first and second mounting members, and first and second leg assembles. Each of the first and second mounting members includes a first opening at or adjacent to a first end portion thereof and a second opening at or adjacent to a second end portion thereof. Each of the first and second openings has a polygonal shape with a plurality of edges. Each of the first and second leg assembles includes a linking member. The linking member includes a first end portion rotatably coupled with the first or second opening of the first mounting member and a second end portion rotatably coupled with the first or second opening of the second mounting member such that the first or second leg assembly is foldable with respect to the table panel. When the first or second leg assembly is unfolded, the first end portion of the linking member abuts at least two edges of the first or second opening of the first mounting member and the second end portion of the linking member abuts at least two edges of the first or second opening of the second mounting member, thereby forming interference fit to reduce vibration when the table is in use.

In an exemplary embodiment, each of the first and second openings has a diamond shape.

In some exemplary embodiments, each of the first and second openings has a first diagonal axis substantially parallel to a length direction of the first or second mounting member, and a second diagonal axis substantially perpendicular to the first diagonal axis.

In various exemplary embodiments, the present disclosure provides a supporting frame including first and second mounting members, and first and second leg assembles. Each of the first and second mounting members includes a first opening at or adjacent to a first end portion thereof and a second opening at or adjacent to a second end portion thereof. Each of the first and second leg assembles includes a linking member rotatably coupled with the first and second mounting members such that the first or second leg assembly is foldable with respect to the table panel. The linking member includes a tapered first end portion and a tapered second end portion. The tapered first end portion facilitates insertion into the first or second opening of the first mounting member, and forms interference fit with the first or second opening of the first mounting member once inserted. The tapered second end portion facilitates insertion into the first or second opening of the second mounting member, and forms interference fit with the first or second opening of the second mounting member once inserted. As such, vibration is reduced when the table is in use.

In an exemplary embodiment, each of the first and second openings has a substantially circular shape, and each of the first and second end portions of the linking member has a substantially conic or truncated conic shape.

The frames and tables of the present disclosure have other features and advantages that will be apparent from, or are set forth in more detail in, the accompanying drawings, which are incorporated herein, and the following Detailed Description, which together serve to explain certain principles of exemplary embodiments of the present disclosure.

BRIEF DESCRIPTION OF THE DRAWINGS

The accompanying drawings, which are incorporated into and constitute a part of this specification, illustrate one or more exemplary embodiments of the present disclosure and, together with the Detailed Description, serve to explain the principles and implementations of exemplary embodiments of the invention.

Figure 1A:
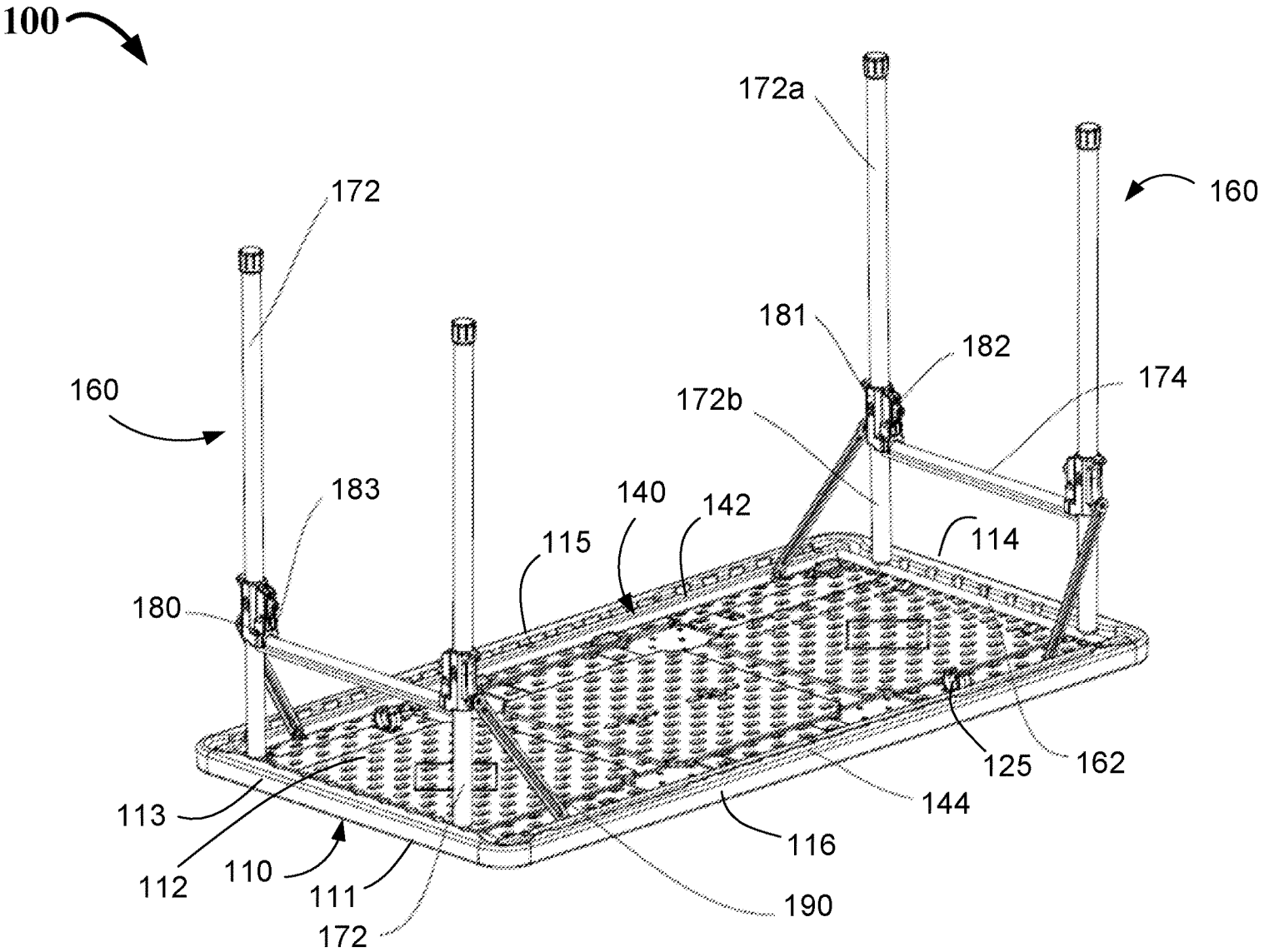
FIG. 1A is a bottom perspective view illustrating an exemplary table in an unfolded state in accordance with exemplary embodiments of the present disclosure.

As will be apparent to those of skill in the art, the components illustrated in the figures described above are combinable in any useful number and combination. The figures are intended to be illustrative in nature and are not limiting.

DETAILED DESCRIPTION

Reference will now be made in detail to implementations of exemplary embodiments of the present disclosure as illustrated in the accompanying drawings. The same reference indicators will be used throughout the drawings and the following detailed description to refer to the same or like parts. Those of ordinary skill in the art will understand that the following detailed description is illustrative only and is not intended to be in any way limiting. Other embodiments of the present disclosure will readily suggest themselves to such skilled persons having benefit of this disclosure.

In the interest of clarity, not all of the routine features of the implementations described herein are shown and described. It will be appreciated that, in the development of any such actual implementation, numerous implementation-specific decisions are made in order to achieve the developer's specific goals, such as compliance with application- and business-related constraints, and that these specific goals will vary from one implementation to another and from one developer to another. Moreover, it will be appreciated that such a development effort might be complex and time-consuming, but would nevertheless be a routine undertaking of engineering for those of ordinary skill in the art having the benefit of this disclosure.

Many modifications and variations of the exemplary embodiments set forth in this disclosure can be made without departing from the spirit and scope of the exemplary embodiments, as will be apparent to those skilled in the art. The specific exemplary embodiments described herein are offered by way of example only, and the disclosure is to be limited only by the terms of the appended claims, along with the full scope of equivalents to which such claims are entitled.

Embodiments of the present disclosure are described in the context of frames and tables with structures that reduces vibration when the tables are in use. Generally, a table of the present disclosure includes a table panel, a mounting frame, and one or more leg assemblies which can be the same as or different from each other. The mounting frame is integrally formed or coupled with the table panel. Each leg assembly is rotatably coupled with the mounting frame and foldable to the table panel. The table of the present invention is configured with structures to reduce the gap at the connection between the mounting frame and leg assembly when the leg assembly is unfolded. In some exemplary embodiments, the gap is reduced such that interference fit is formed between the mounting frame and leg assembly, and/or between the table panel and leg assembly. The reduction in the gap and, in some cases, the interference fit, reduces vibration when the table is in use, and consequently enhances the stability and usability of the table.

The table panels can be of various shapes including but not limited to a square shape, a round shape or a rectangular shape. The panels can be made of various materials including but not limited to metals, plastics and woods. In some exemplary embodiments, the panels are made of plastics by injection molding, blow molding or any other suitable processes.

The mounting frame, one or more leg assemblies, other additional or optional structures, or any combination thereof, are collectively referred to herein as a supporting frame. The supporting frames of the present disclosure can be made of various materials including but not limited to metals (e.g., iron, steel, and aluminum) and plastics. In some exemplary embodiments, some components of a supporting frame (e.g., bars) are made of metals or the like while some other components (e.g., couplers, sliders) are made of plastics, rubbers or the like.

Referring now to FIGS. 1A-4B, there is depicted exemplary table 100 in accordance with some embodiments of the present disclosure. As shown, table 100 includes a table panel such as table panel 110, a mounting frame such as mounting frame 140, and one or more leg assemblies. The one or more leg assemblies can be the same as or different from each other. By way of example, table 100 is shown with first and second leg assemblies such as leg assembly 160.

Table panel 110 has first surface 111 and second surface 112. The first and second surfaces of the table panel are generally the upper and lower surfaces of the table panel. Table panel 110 also includes a plurality of edges such as first edge 113, second edge 114, third edge 115 and four edge 116. A plurality of retainers are integrally formed (e.g., during the blow molding process) or coupled (e.g., glued or fastener) with the table panel. In some exemplary embodiments, the plurality of retainers includes at least one first retainer disposed adjacent to the first edge of the table panel and at least one second retainer disposed adjacent to the second edge of the table panel. The first and second retainers can be the same as or different from each other. By way of example, two retainers 120 are shown adjacent to each of first edge 113 and second edge 114 of the table panel.

Figure 3A:
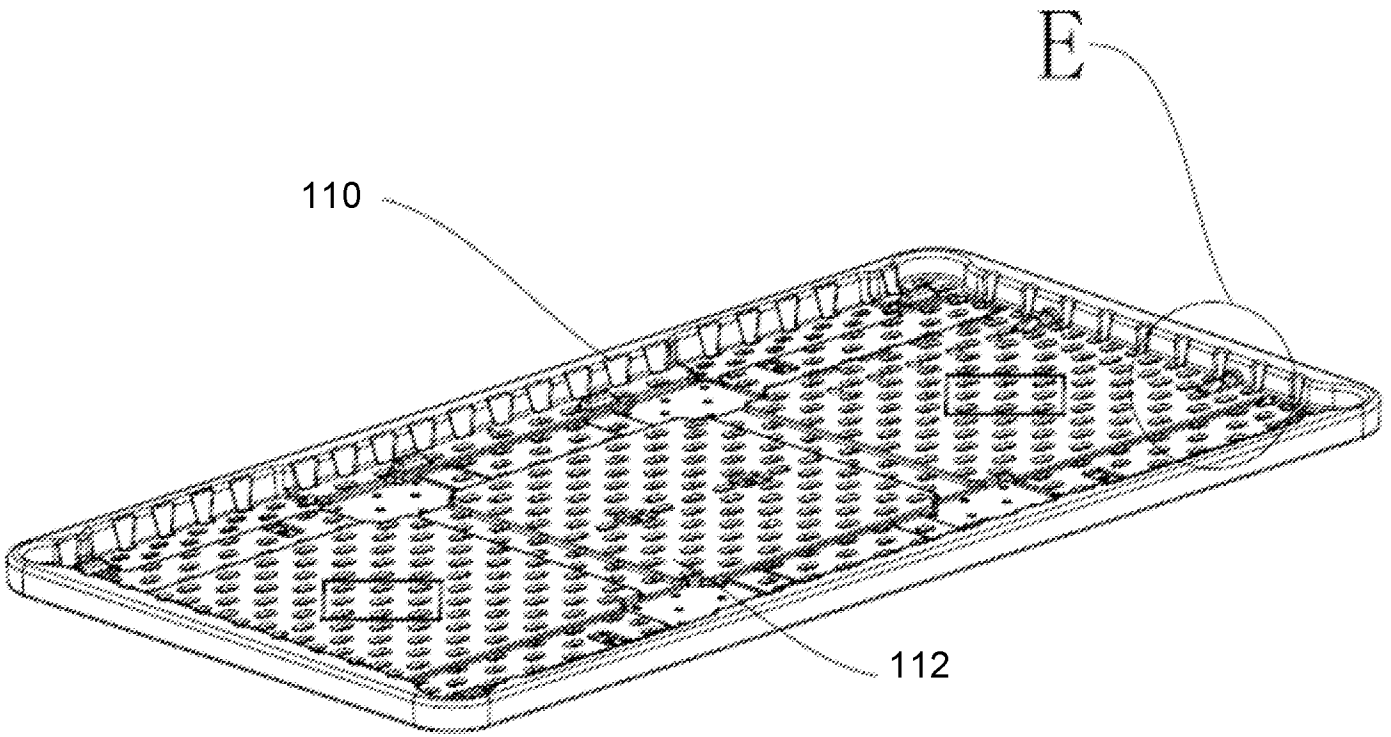
FIG. 3A is a bottom perspective view illustrating an exemplary table panel in accordance with exemplary embodiments of the present disclosure.
Figure 3B:
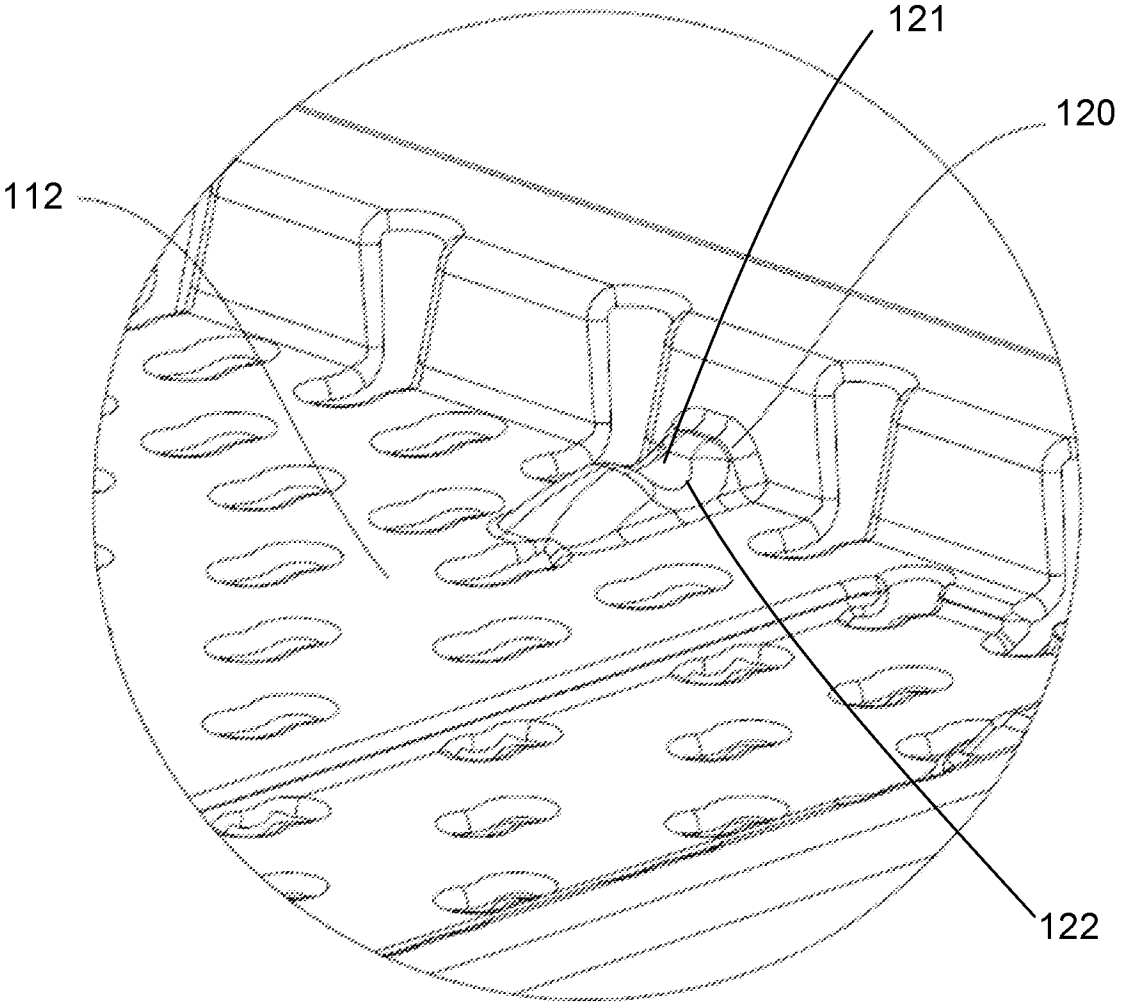
FIG. 3B is an enlarged view taken along circle E of FIG. 3A.

Retainer 120 protrudes away from the second surface of the table panel (e.g., upwardly in FIGS. 1A and 3B).

Figure 4A:
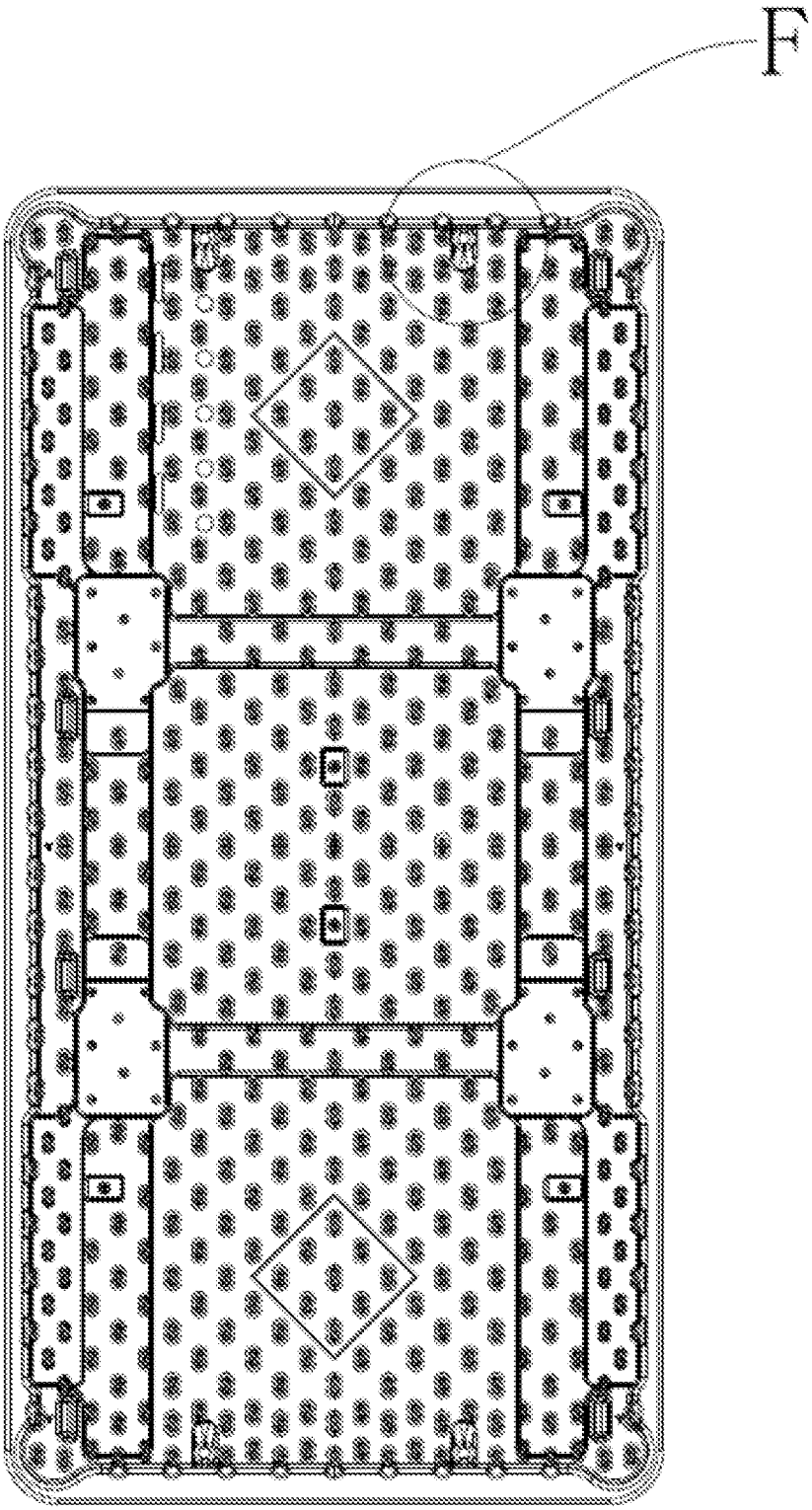
FIG. 4A is a bottom view illustrating the exemplary table panel of FIG. 3A in accordance with exemplary embodiments of the present disclosure.
Figure 4B:
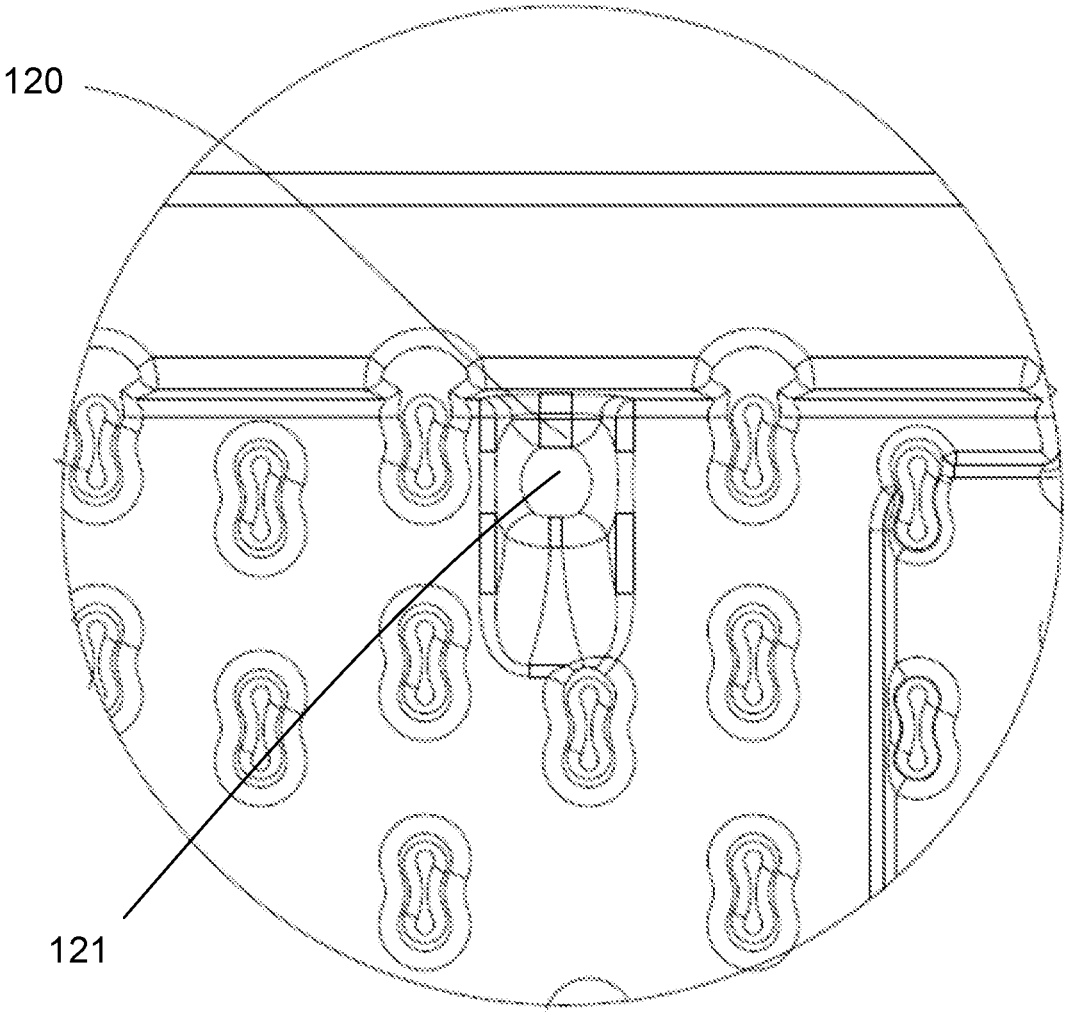
FIG. 4B is an enlarged view taken along circle F of FIG. 4A.

Referring in particular to FIGS. 3B and 4B, there is depicted exemplary retainer 120 in accordance with some exemplary embodiments of the present disclosure. As shown, retainer 120 is integrally formed or coupled with second surface 112 of the table panel and protruded away from the second surface (e.g., at least a portion of the retainer is above the second surface as illustrated in FIG. 3B). In some exemplary embodiments, retainer 120 is formed with a recess such as recess 121 concaved toward the second surface of the table panel. Recess 121 is formed with a bottom as bottom 122 protruding away from the second surface of the table panel (e.g., the bottom is above the second surface as illustrated in FIG. 3B).

Figure 1B:
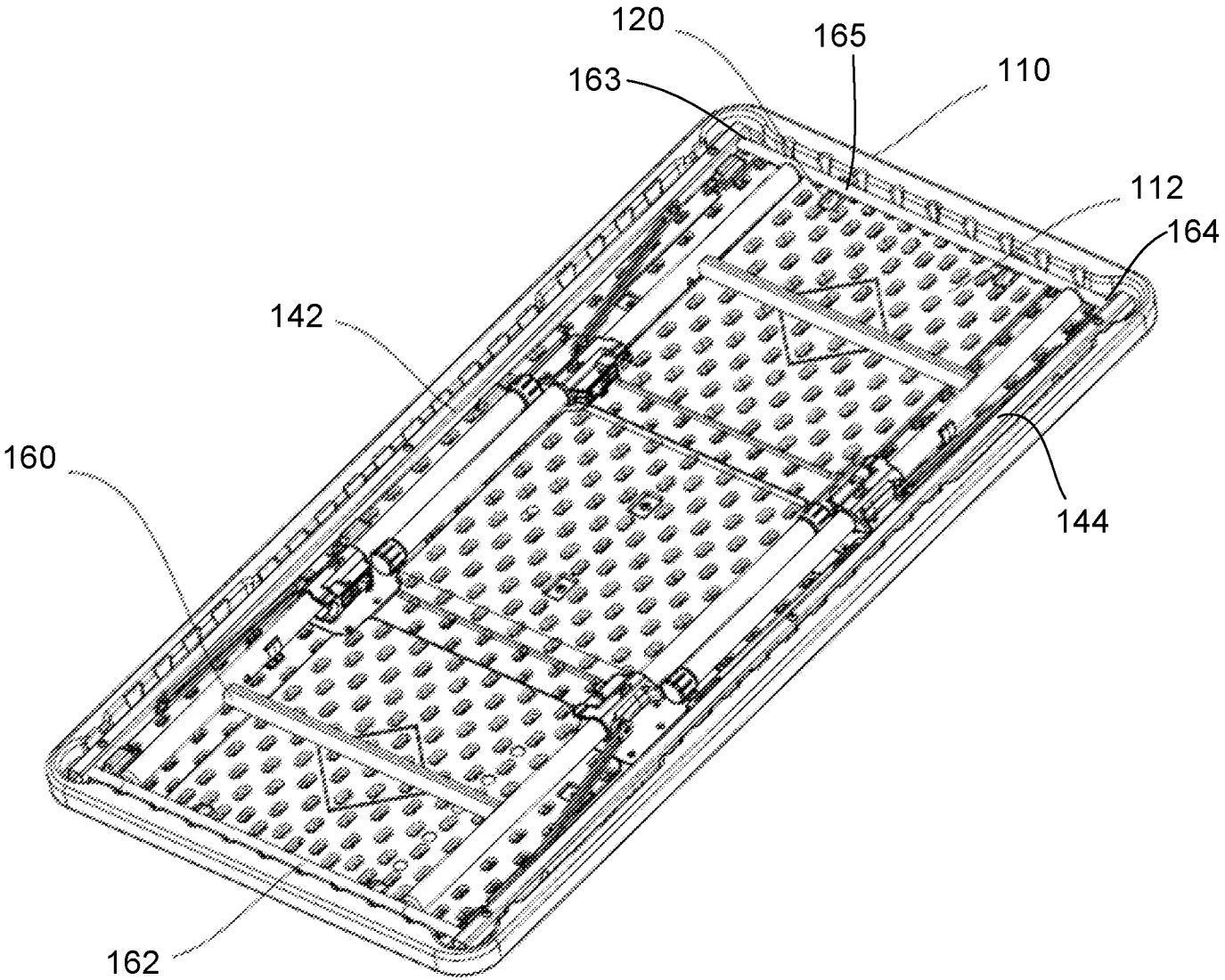
FIG. 1B is a bottom perspective view illustrating the exemplary table of FIG. 1A in a folded state in accordance with exemplary embodiments of the present disclosure.

Referring in particular to FIGS. 1A and 1B, in some exemplary embodiments, the plurality of retainers includes at least one third retainer and at least one fourth retainer integrally formed or coupled with the table panel. The third and fourth retainers can be the same as or different from each other. The third and fourth retainers can also be aligned with each other along the length direction of the table panel or staggered with respect to each other, e.g., not aligned along the length or width direction of the table panel. By way of example, two retainers 125 are shown, one adjacent to third edge 115 and one adjacent to four edge 116 of the table panel.

In some exemplary embodiments, each of the third and fourth retainers includes a base integrally formed or coupled with the table panel and two lever arms extended from the table collectively forming a receiving portion that receives a leg or a portion of a leg (cross-section-wise). Examples of such retainers and/or other relevant features are disclosed in U.S. patent application Ser. No. 17/069,458, the disclosure of the application is incorporated herein for all purposes by reference in its entirety.

Mounting frame 140 is integrally formed (e.g., during the blow molding process) or coupled (e.g., glued or fastener) with the table panel. In some exemplary embodiments, mounting frame 140 includes a first mounting member such as first mounting member 142 and a second mounting member such as second mounting member 144. The first mounting member is coupled or integrally formed with the table panel adjacent to the third edge of the table panel and the second mounting member coupled or integrally formed with the table panel adjacent to the third edge of the table panel. The first and second mounting members can be the same or different from each other. Each of the first and second mounting members includes a first opening adjacent to the first edge of the table panel and a second opening adjacent to the second edge of the table panel. The first and second openings can be the same as or different from each other. By way of example, the first and second mounting members are shown to be substantially the same with opening 146 adjacent to each of first edge 113 and second edge 114 of the table panel. In an exemplary embodiment, opening 146 has a substantially circular shape.

Figure 2A:
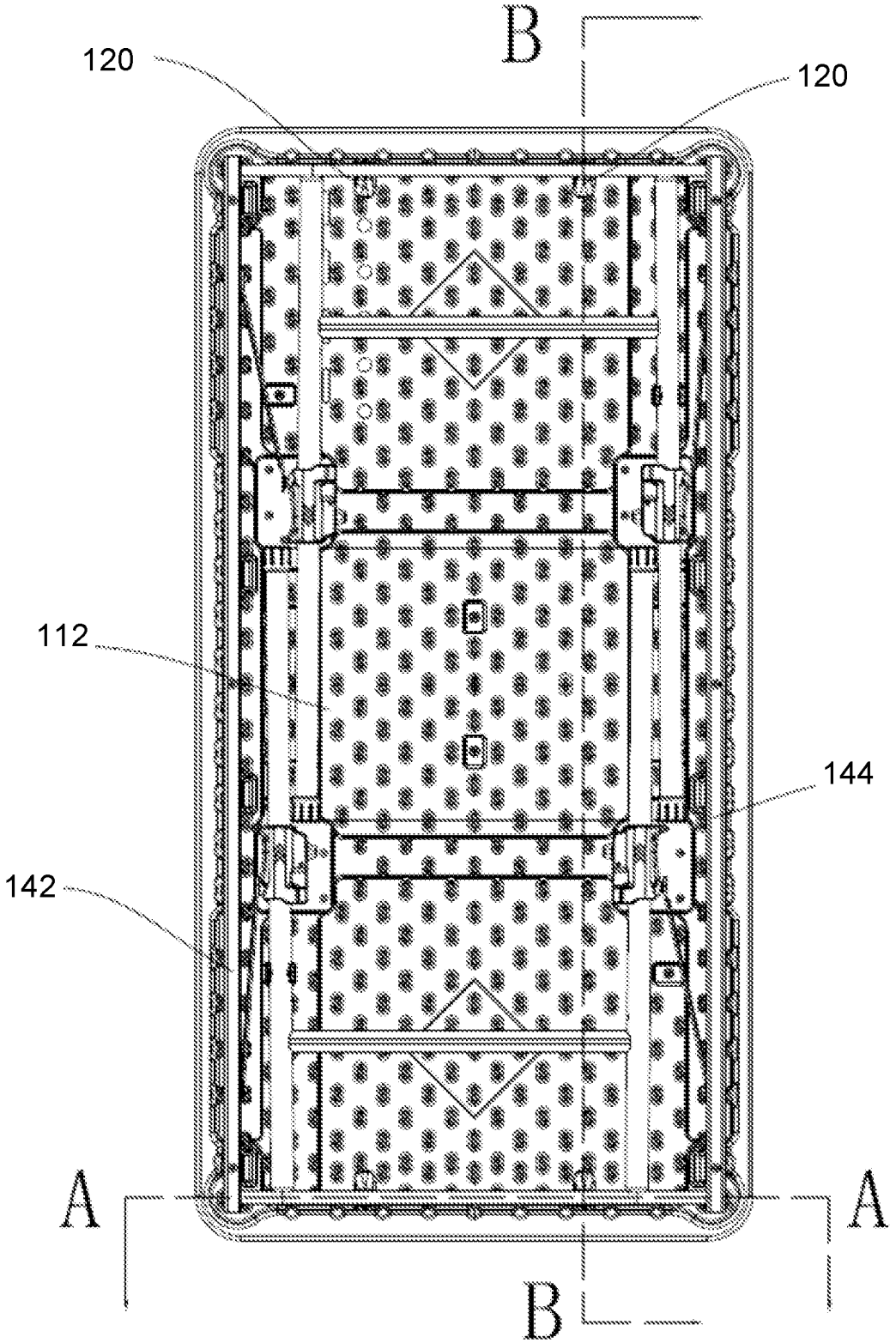
FIG. 2A is a bottom view illustrating the exemplary table of FIG. 1A in a folded state in accordance with exemplary embodiments of the present disclosure.
Figure 2B:
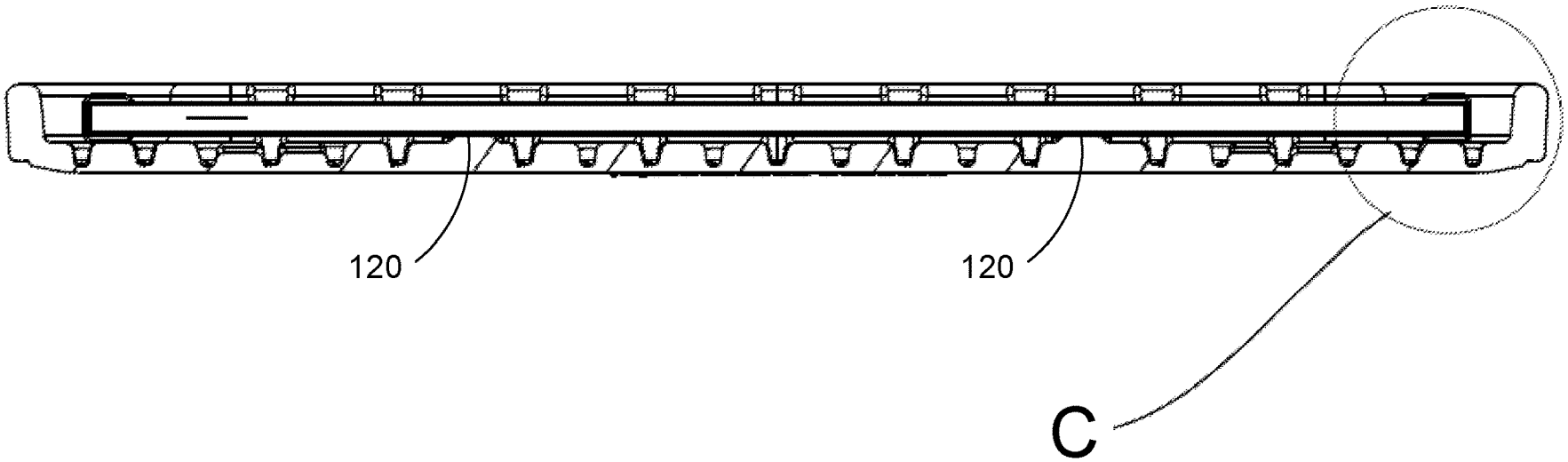
FIG. 2B is a cutout view taken along line A-A of FIG. 2A.
Figure 2C:
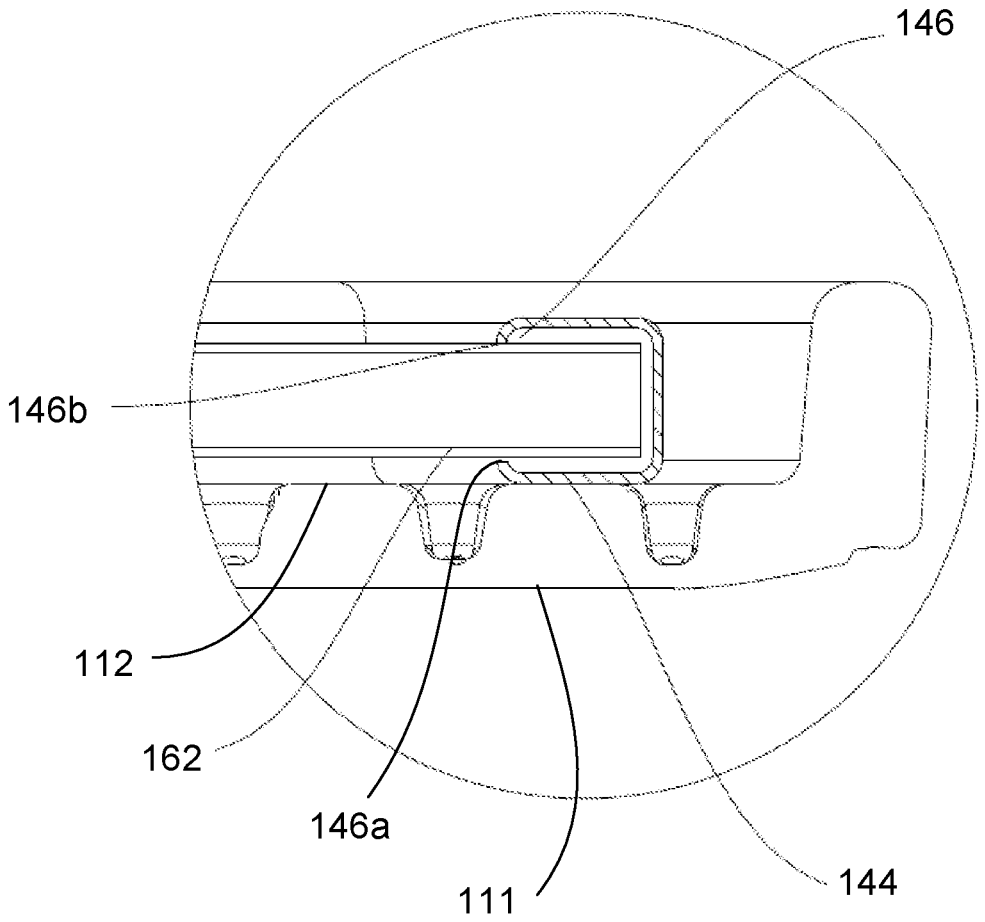
FIG. 2C is an enlarged view taken along circle C of FIG. 2B.
Figure 2D:
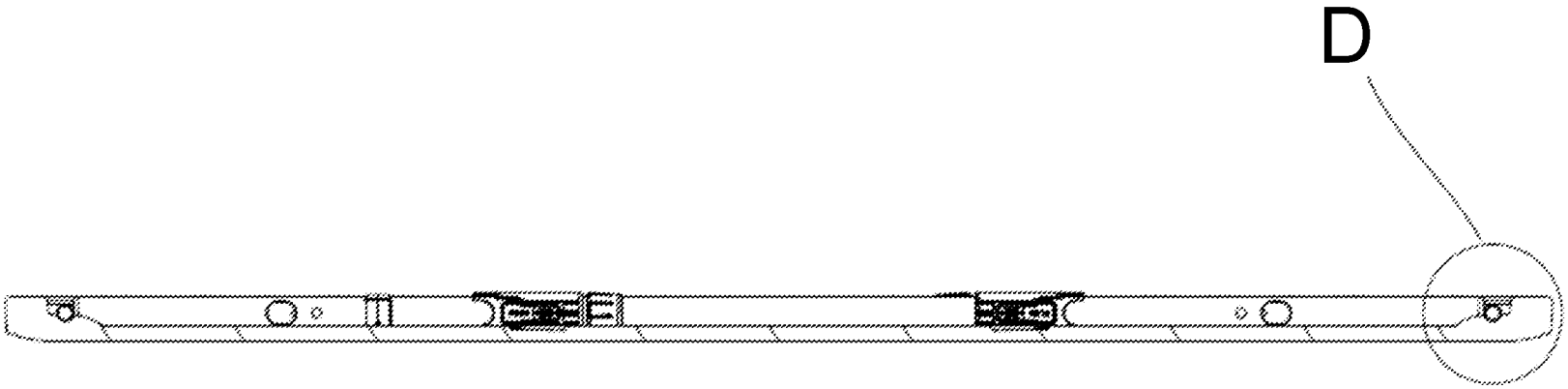
FIG. 2D is a cutout view taken along line B-B of FIG. 2A.

The first openings of the first and second mounting members are aligned with the at least one first retainer, e.g., openings 146 adjacent to first edge 113 are aligned with retains 120 adjacent to first edge 113. Similarly, the second openings of the first and second mounting members are aligned with the at least one second retainer, e.g., openings 146 adjacent to second edge 114 are aligned with retains 120 adjacent to second edge 114. Each of the first and second openings of the first and second mounting members has a near portion that is relatively closer to the second surface of the table panel and a far portion that is relatively farther away from the second surface of the table panel. For instance, as illustrated in FIG. 2C, opening 146 has near portion 146*a* relatively closer to second surface 112 of the table panel and far portion 146*b* relatively farther away from the second surface of the table panel compared to near portion 146*a*.

Each of the first and second leg assemblies includes a linking member for rotatably connecting the leg assembly with the mounting frame such that the leg assembly can be folded onto the table panel. For instance, leg assembly 160 includes linking member 162. The first leg assembly has linking member 162 disposed adjacent to first edge 113 of the table panel and the second leg assembly has linking member 162 disposed adjacent to second edge 114 of the table panel.

Linking member 162 includes a first end portion such as first end portion 163 and a second end portion such as second end portion 164. First end portion 163 is rotatably coupled with opening 146 of the first mounting member. Second end portion 164 is rotatably coupled with opening 146 of the second mounting member. As such, leg assembly 160 is rotatable respect to the table panel between a use position as illustrated in FIG. 1A (the table is in an unfolded state) and a storage position as illustrated in FIG. 1B (the table is in a folded state).

Figure 2E:
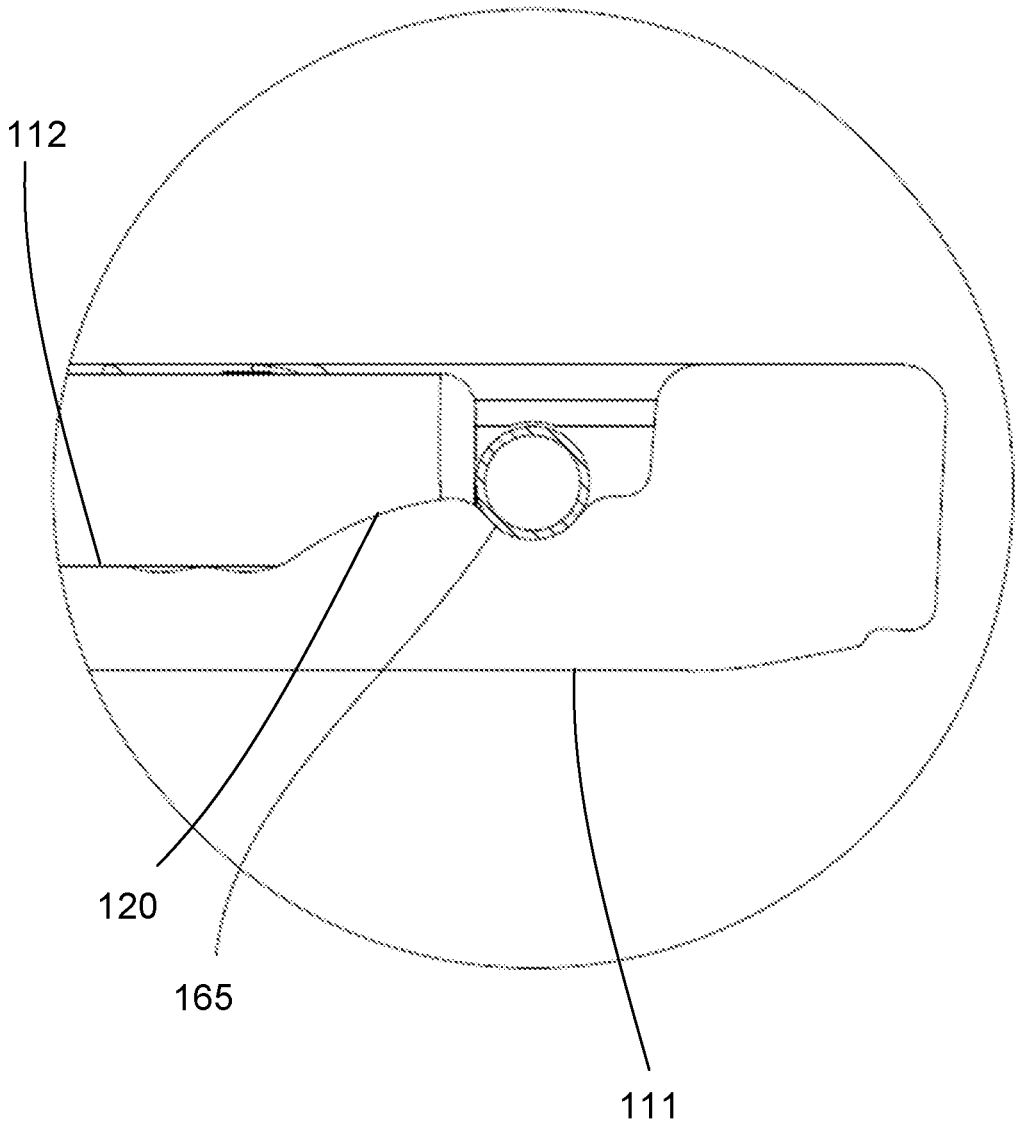
FIG. 2E is an enlarged view taken along circle D of FIG. 2D.

In some exemplary embodiments, linking member 162 further includes an engagement portion such as engagement portion 165 between the first and second end portions. The engagement portion can have any suitable shape and length. In an exemplary embodiment, the engagement portion of the linking member has a substantially circular cross-section as illustrated in FIG. 2E.

The engagement portion is configured to couple with retainer 120. For instance, in some exemplary embodiments, the engagement portion abuts against retainer 120 when the leg assembly is unfolded, e.g., in the use position as illustrated in FIG. 1A. In some exemplary embodiments, recess 121 of retainer 120 receives, cross-section-wise, at least a portion of the engagement portion of the linking member. In some exemplary embodiments, a gasket, a padding or the like is provided at the recess or at the engagement portion of the linking member.

The abutting of the engagement portion against the retainer pushes the first end portion toward far portion 146*b* of opening 146 of the first mounting member and the second end portion toward far portion 146*b* of opening 146 of the second mounting member. Consequently, it reduces the gap between the first end portion and far portion 146*b* of opening 146 of the first mounting member and reduces the gap between the second end portion and far portion 146*b* of opening 146 of the second mounting member.

In some exemplary embodiments, the abutting of the engagement portion (e.g., engagement portion 165) against the at least one first or second retainer (e.g., retainer 120) reduces the gap between the first or second end portion of the linking member (e.g., linking member 162) and the far portion of the opening of the first or second mounting member up to 2 millimeters, up to 3 millimeters, up to 4 millimeters, or up to 5 millimeters. In some exemplary embodiments, the abutting of the engagement portion against the retainer pushes the first end portion toward far portion 146*b* of opening 146 of the first mounting member and the second end portion toward far portion 146*b* of opening 146 of the second mounting member until the first end portion abuts against far portion 146*b* of opening 146 of the first mounting member and the second end portion abuts against far portion 146*b* of opening 146 of the second mounting member. As such, when the leg assembly is unfolded, the linking member forms interference or tighter fit with all of the first mounting member, the second mounting member and the table panel. This significantly reduces vibration when the table is in use.

In some exemplary embodiments, leg assembly 160 includes one or more legs each having an upper end portion fixedly coupled with the link member. The one or more legs can be the same as or different from each other. By way of example, leg assembly 160 is illustrated with two legs 172 each having an upper end portion fixedly coupled with link member 162. In an exemplary embodiment, leg assembly 160 also includes a leg connecting member such as leg linking member 174 disposed between the first and second legs and connected with the first and second legs. In some exemplary embodiments where the table panel has retainer 125, at least one leg of leg assembly 160 is coupled with retainer 125 (e.g., cross-section-wise, at least a portion of the leg is received in the retainer) when folded to the table panel. Retainer 125 retains the leg assembly and prevents it from accidental unfolding.

In some exemplary embodiments, leg assembly 160 is adjustable in length. For instance, in an exemplary embodiment, each of the first and second legs of leg assembly 160 includes first bar 172*a* and second bar 172*b* telescopically coupled with each other and a locking/unlocking mechanism to control relative movement of the first and second bars. Examples of adjustable leg assemblies and/or other relevant features are disclosed in U.S. patent applications Ser. Nos. 15/400,861, 15/931,925, 16/838,939, 16/838,944, 17/000,661, 17/003,047, 17/038,369 and 17/069,458, the disclosure of each application is incorporated herein for all purposes by reference in its entirety. As such, when unfolded, one can change the height of the table panel by adjusting collectively the lengths of the first and second legs of the leg assemblies. In some exemplary embodiments, the height of the table panel is adjustable for at least two, three, four or more positions.

In some exemplary embodiments, corresponding to one or each of the first and second legs, leg assembly 160 includes a slider such as slider 180 and a supporting member such as supporting member 190 to couple the leg with the first or second mounting member. Examples of sliders are disclosed in U.S. patent applications Ser. Nos. 16/838,939, 16/838,944 and 16/838,947, the disclosure of each application is incorporated herein for all purposes by reference in its entirety.

Slider 180 can be disposed at a leg or a mounting member. By way of example, slider 180 is shown at the leg. In an exemplary embodiment, slider 180 includes a body such as body 181 configured to sleeve on the leg such that slider 180 is movable along the length direction of the leg. Supporting member 190 has an end portion pivotally connected with the slider and another end portion pivotally connected with the first or second mounting member. As such, the combination of the slider and supporting member assists in guiding the folding and unfolding of the leg assembly with respect to the table panel.

Slider 180 also includes a button such as button 182. Button 182 is operably coupled with the body to selectively restrict body 181 of the slider from moving along the length direction of the leg. For instance, when the table is in use, the button operates to restrict body 181 of the slider from moving along the length direction of the leg. As such, the combination of the slider and supporting member assists in supporting the table panel and prevents accidental folding of the leg assembly.

In some exemplary embodiments, slider 180 includes additional, optional or alternative features. For instance, in some exemplary embodiments, a notch such as notch 183 is formed at the body of the slider and configured to couple with the leg linking member when the leg assembly is unfolded. The coupling of the notch with the leg linking member prevents the leg from unfolding beyond its use position.

Referring now to FIGS. 5A-7G, there is depicted exemplary table 200 in accordance with some embodiments of the present disclosure. Similar to table 100, table 200 includes table panel 110, first mounting member 142 and second mounting member 144. First mounting member 142 is coupled or integrally formed with the table panel adjacent to the third edge of the table panel and second mounting member 144 is coupled or integrally formed with the table panel adjacent to the third edge of the table panel. Table 200 further includes one or more leg assemblies, which can be the same as or different from each other. By way of example, table 200 is shown with two leg assemblies 260.

In some exemplary embodiments, leg assembly 260 is substantially the same as leg assembly 160 except the linking member. For instance, leg assembly 260 includes a linking member such as linking member 262 for rotatably connecting the leg assembly with the mounting members such that the leg assembly can be folded onto the table panel. Leg assembly 260 also includes first and second legs such as leg 172 each having an upper end portion fixedly coupled with link member 262. Leg assembly 260 can be adjustable or non-adjustable in length. In an exemplary embodiment, leg assembly 260 additionally or optionally includes a leg connecting member such as leg linking member 174 disposed between the first and second legs and connected with the first and second legs. In some exemplary embodiments, corresponding to one or each of the first and second legs, leg assembly 260 includes slider 180 and supporting member 190 to couple the leg assembly with the first or second mounting member.

Figure 5A:
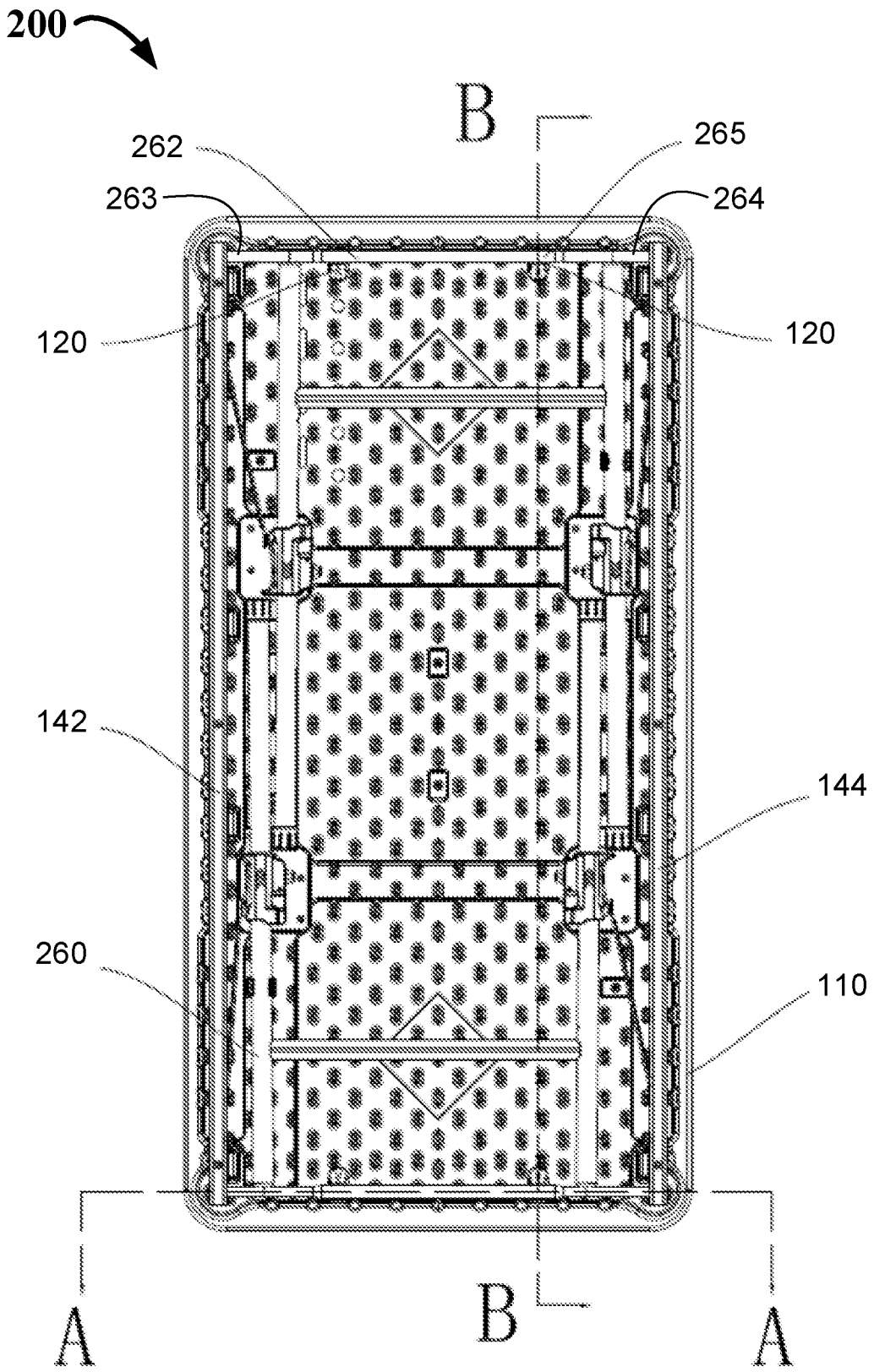
FIG. 5A is a bottom view illustrating an exemplary table in a folded state in accordance with exemplary embodiments of the present disclosure.
Figure 5B:
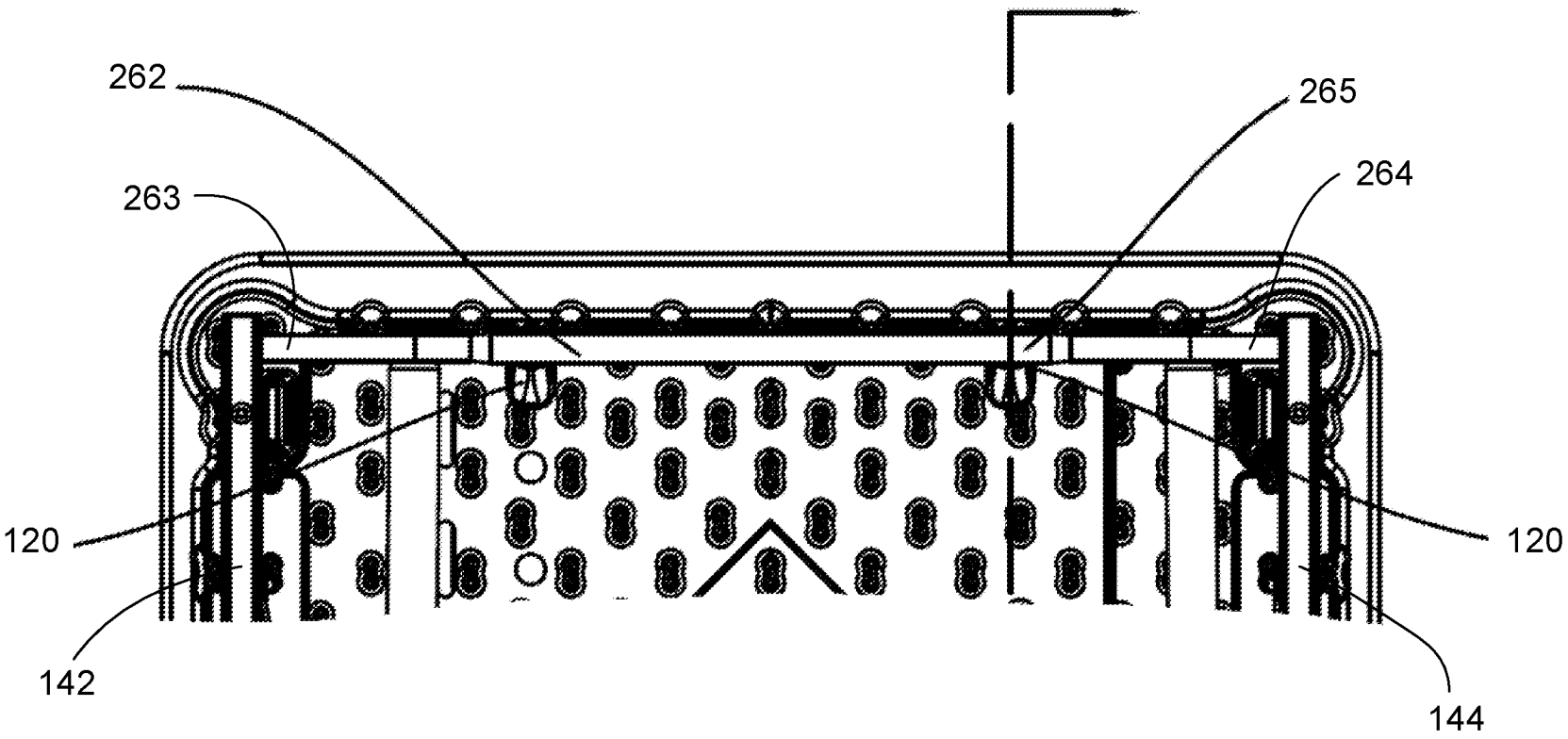
FIG. 5B is a partially enlarged view of FIG. 5A.
Figure 5C:
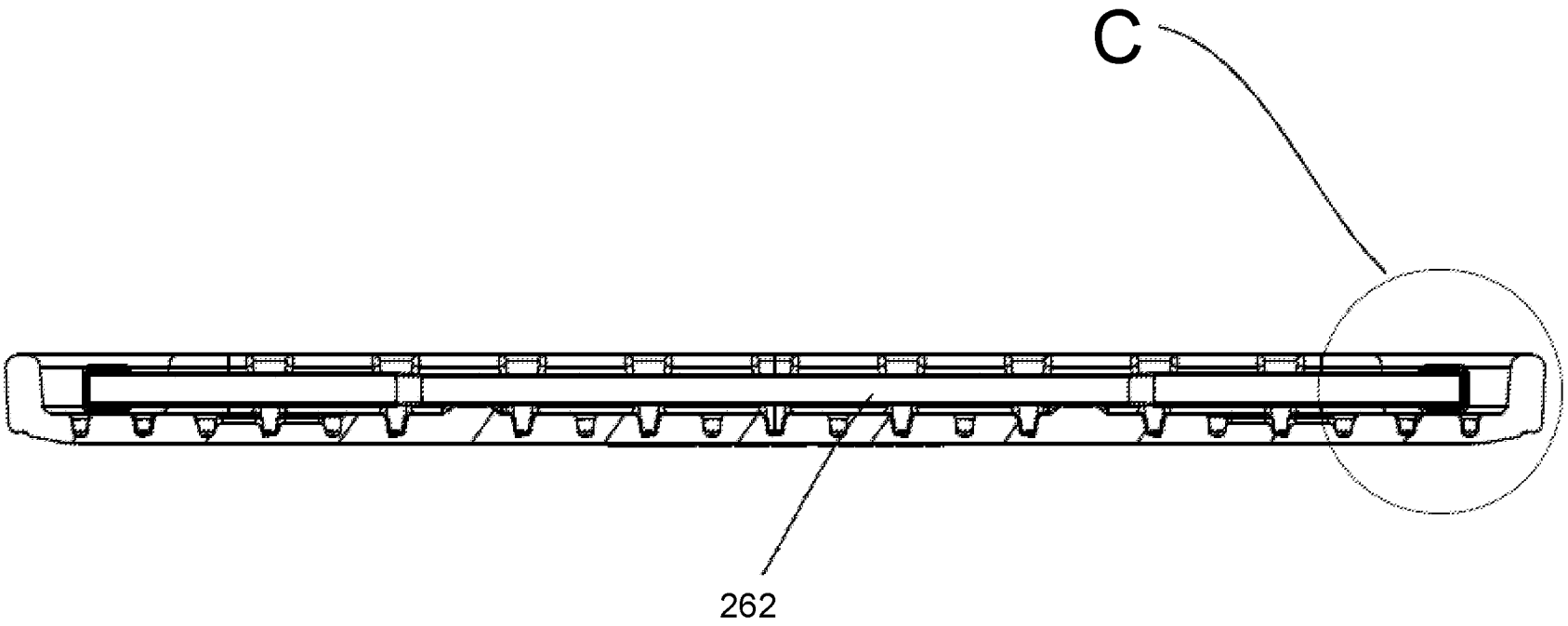
FIG. 5C is a cutout view taken along line A-A of FIG. 5A.
Figure 5D:
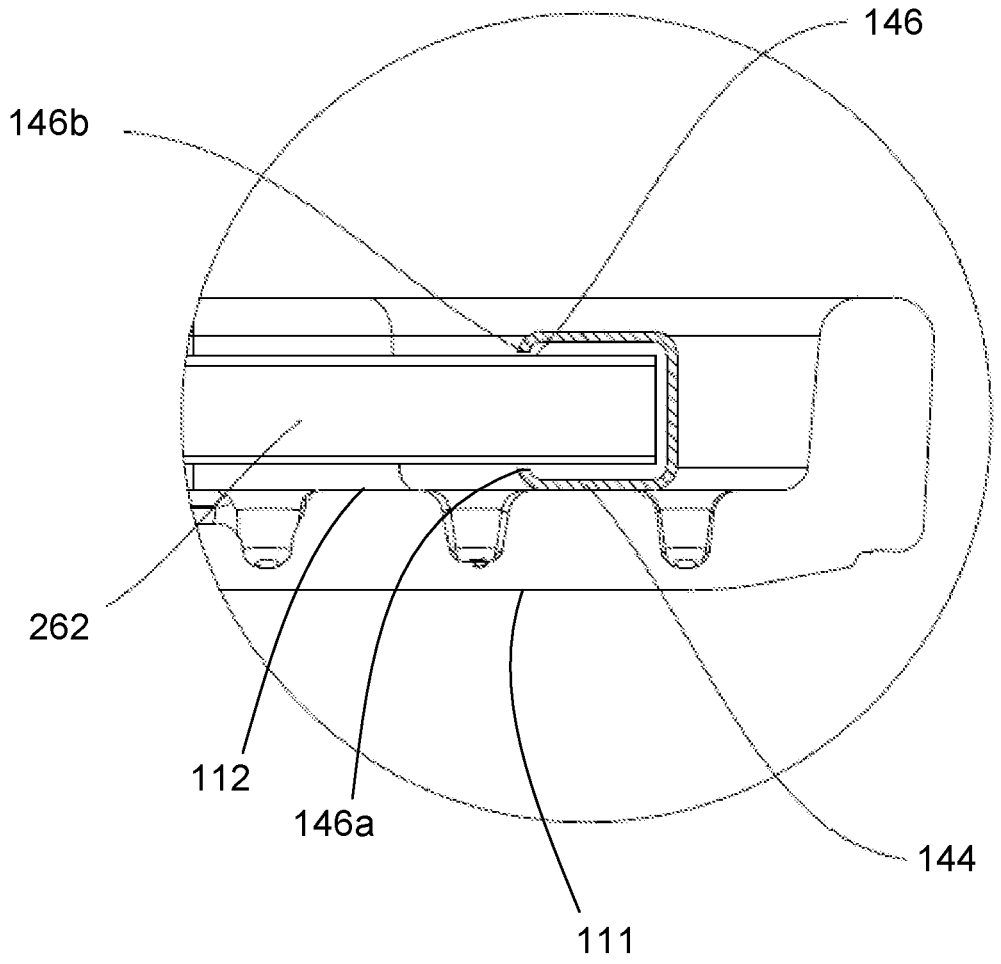
FIG. 5D is an enlarged view taken along circle C of FIG. 5C.
Figure 5E:
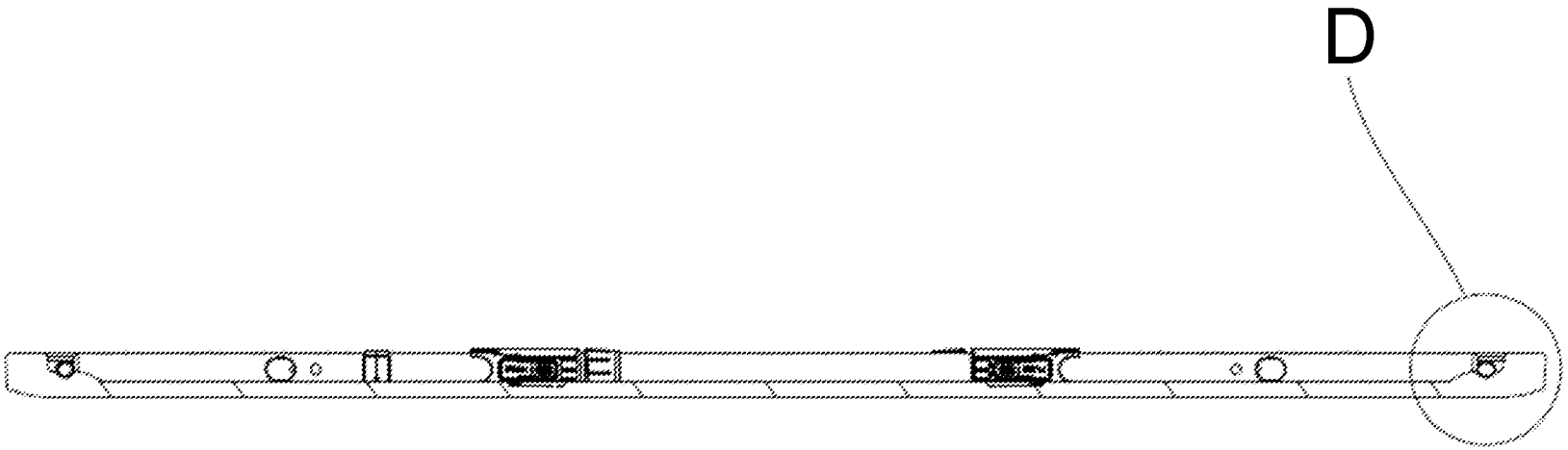
FIG. 5E is a cutout view taken along line B-B of FIG. 5A.
Figure 5F:
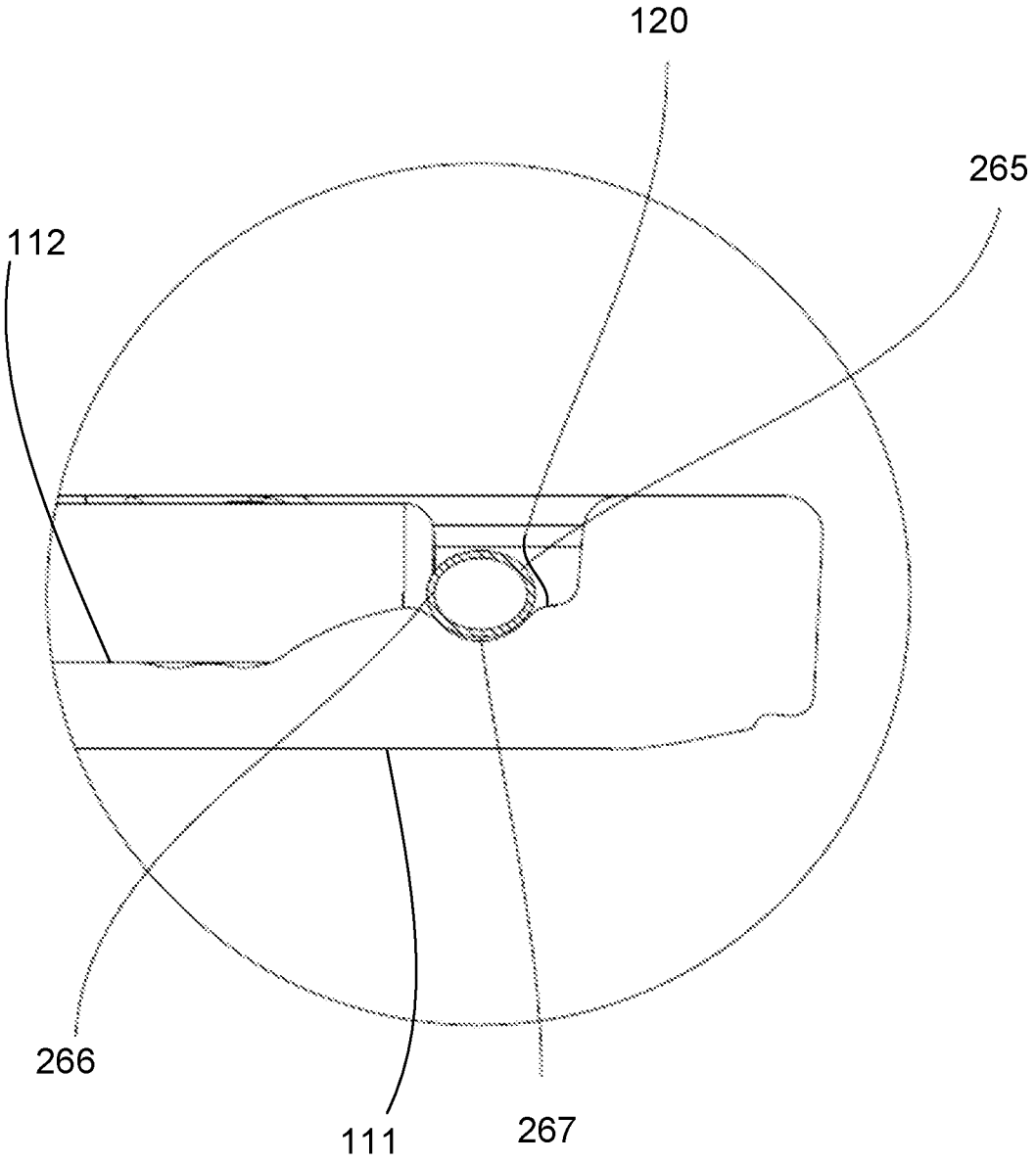
FIG. 5F is an enlarged view taken along circle D of FIG. 5E.
Figure 6A:
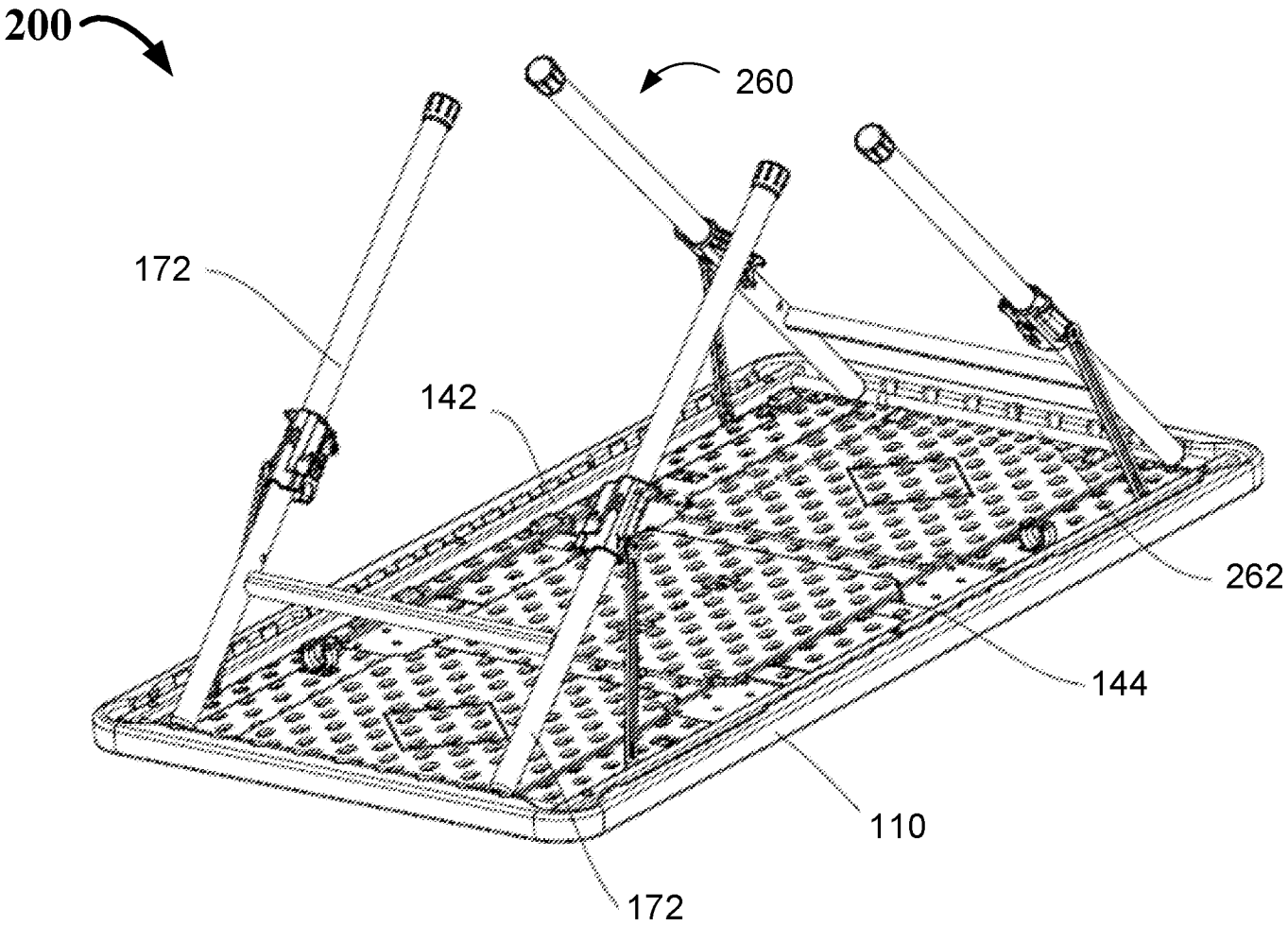
FIG. 6A is a bottom perspective view illustrating the exemplary table of FIG. 5A in an intermediate state in accordance with exemplary embodiments of the present disclosure.
Figure 6B:
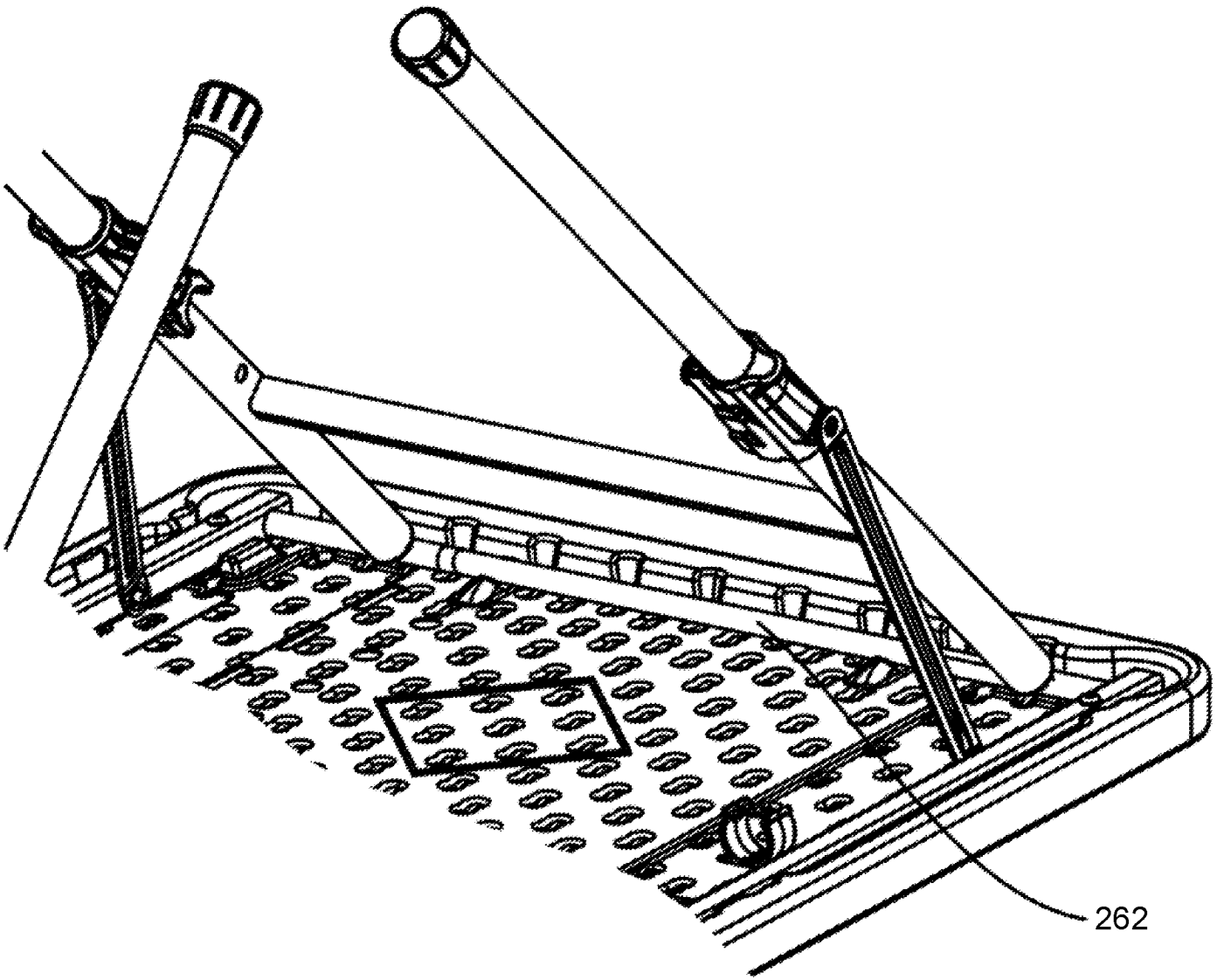
FIG. 6B is a partially enlarged view of FIG. 6A.
Figure 6C:
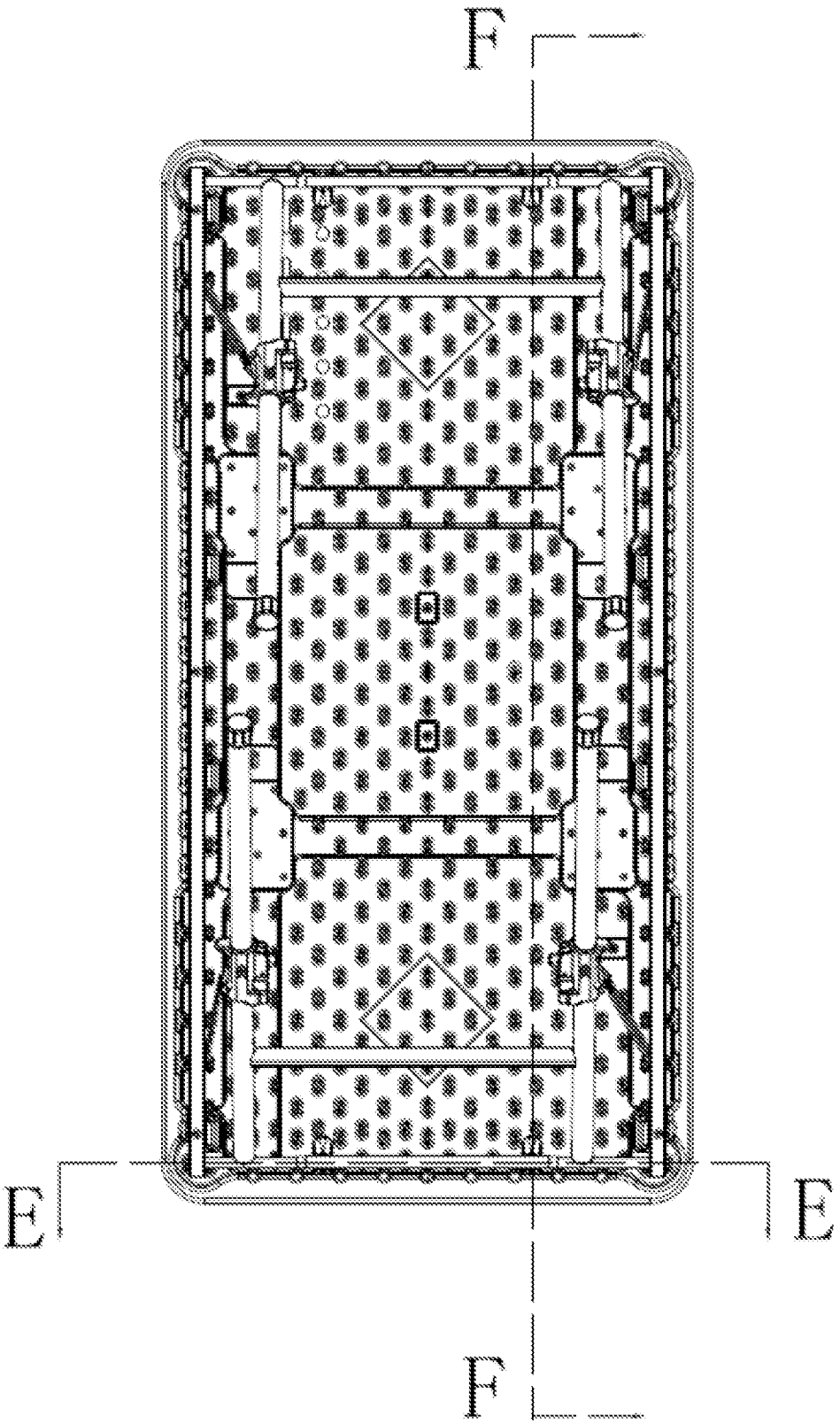
FIG. 6C is a bottom view illustrating an exemplary table in an intermediate state in accordance with exemplary embodiments of the present disclosure.
Figure 6D:
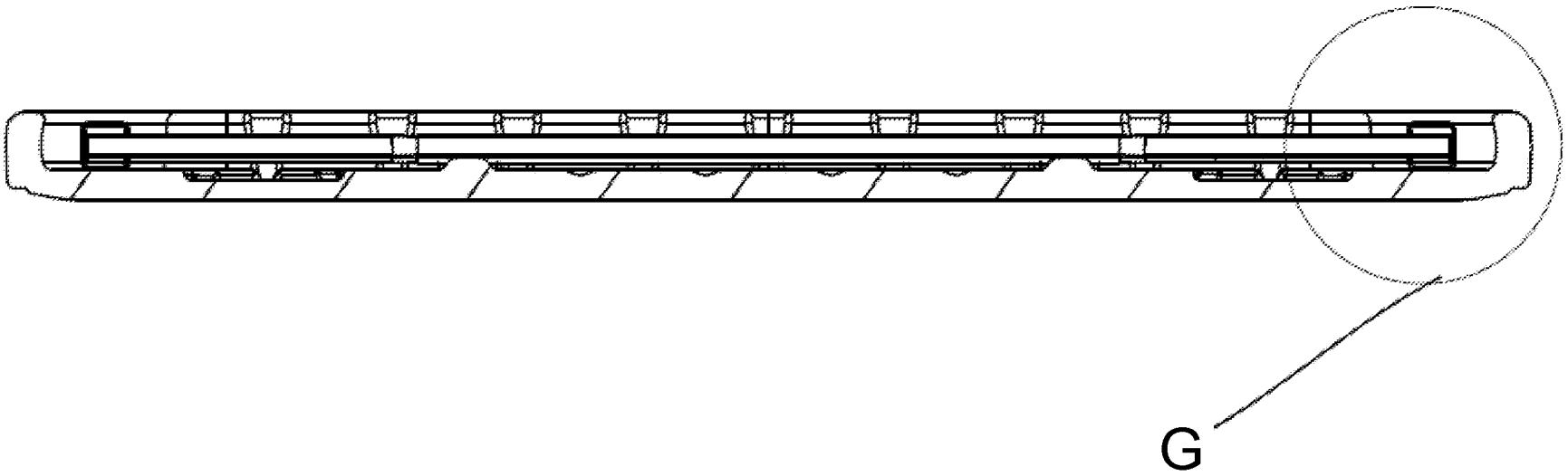
FIG. 6D is a cutout view taken along line E-E of FIG. 6C.
Figure 6E:
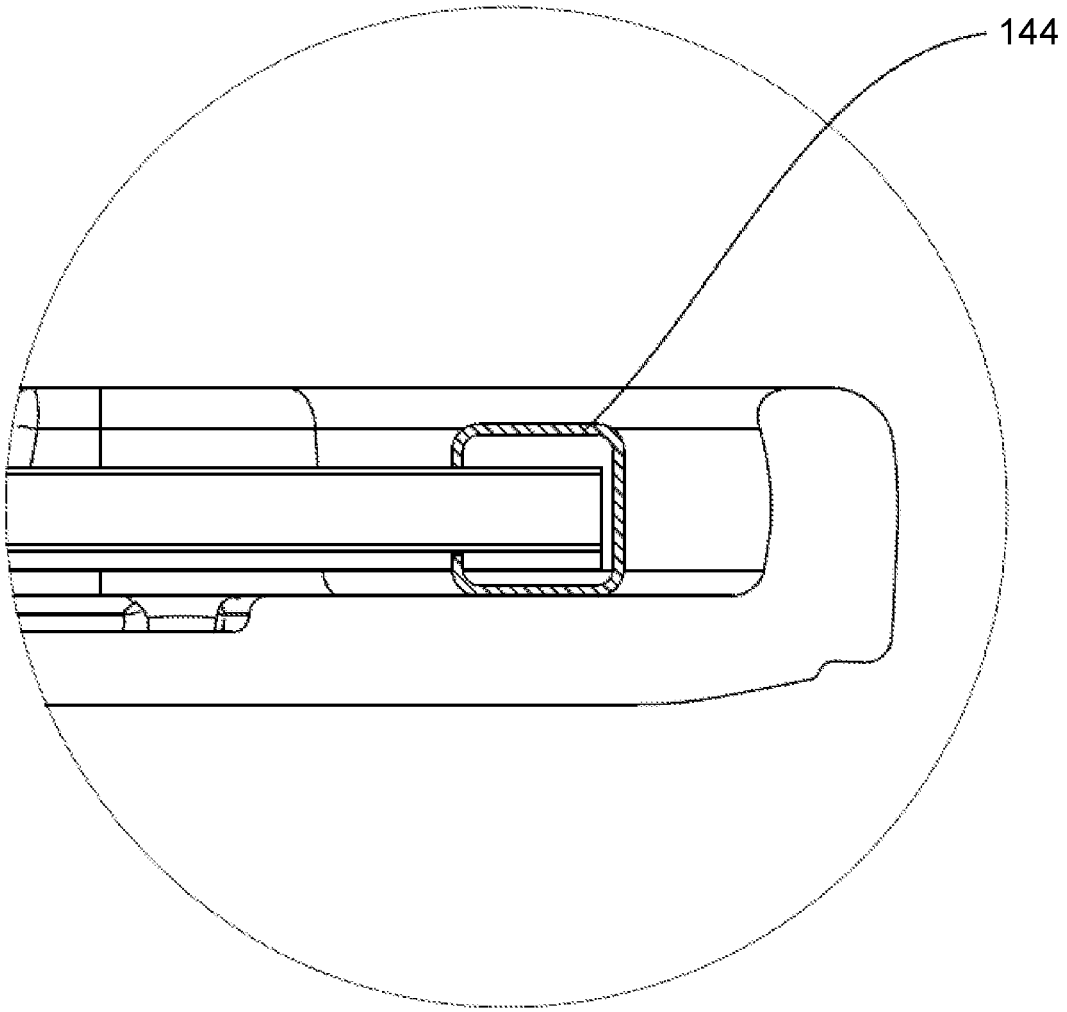
FIG. 6E is an enlarged view taken along circle G of FIG. 6D.
Figure 6F:
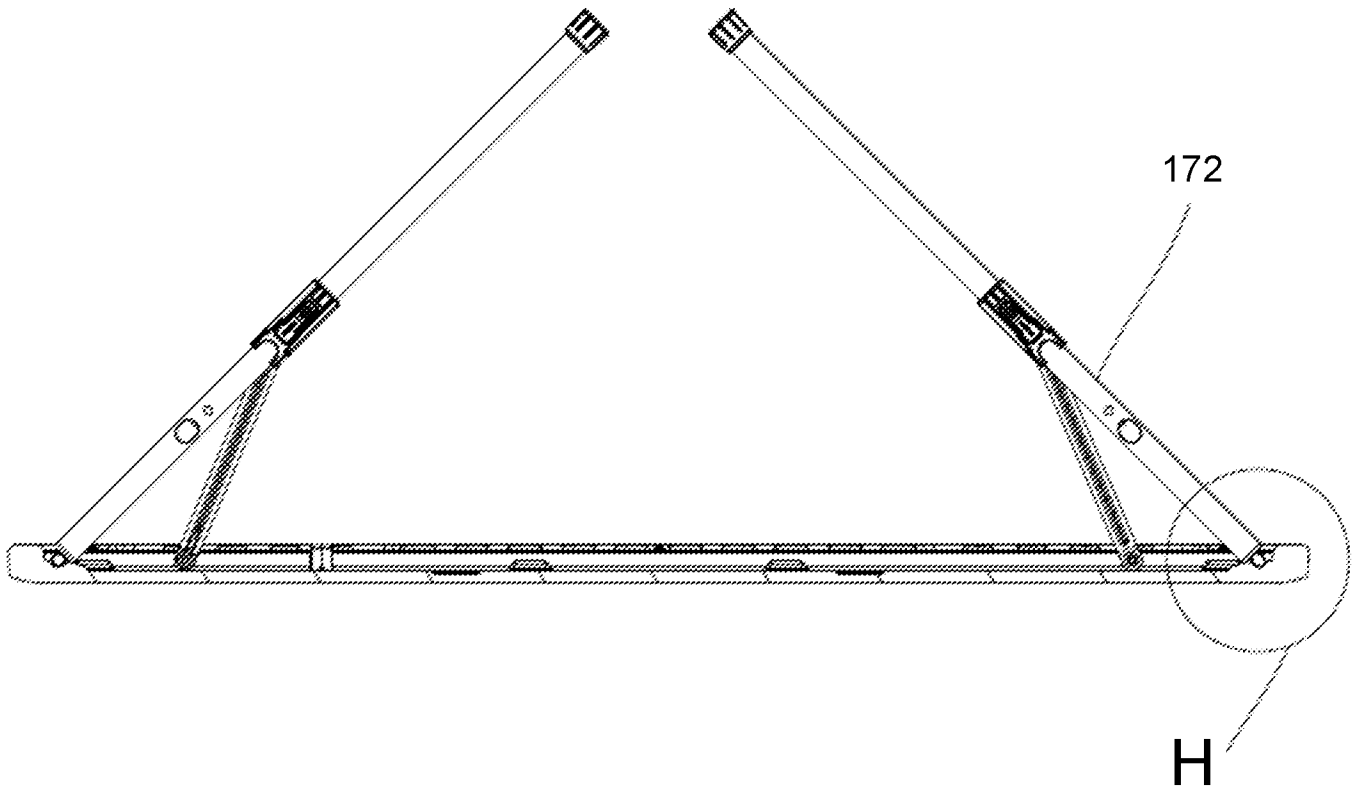
FIG. 6F is a cutout view taken along line F-F of FIG. 6C.
Figure 6G:
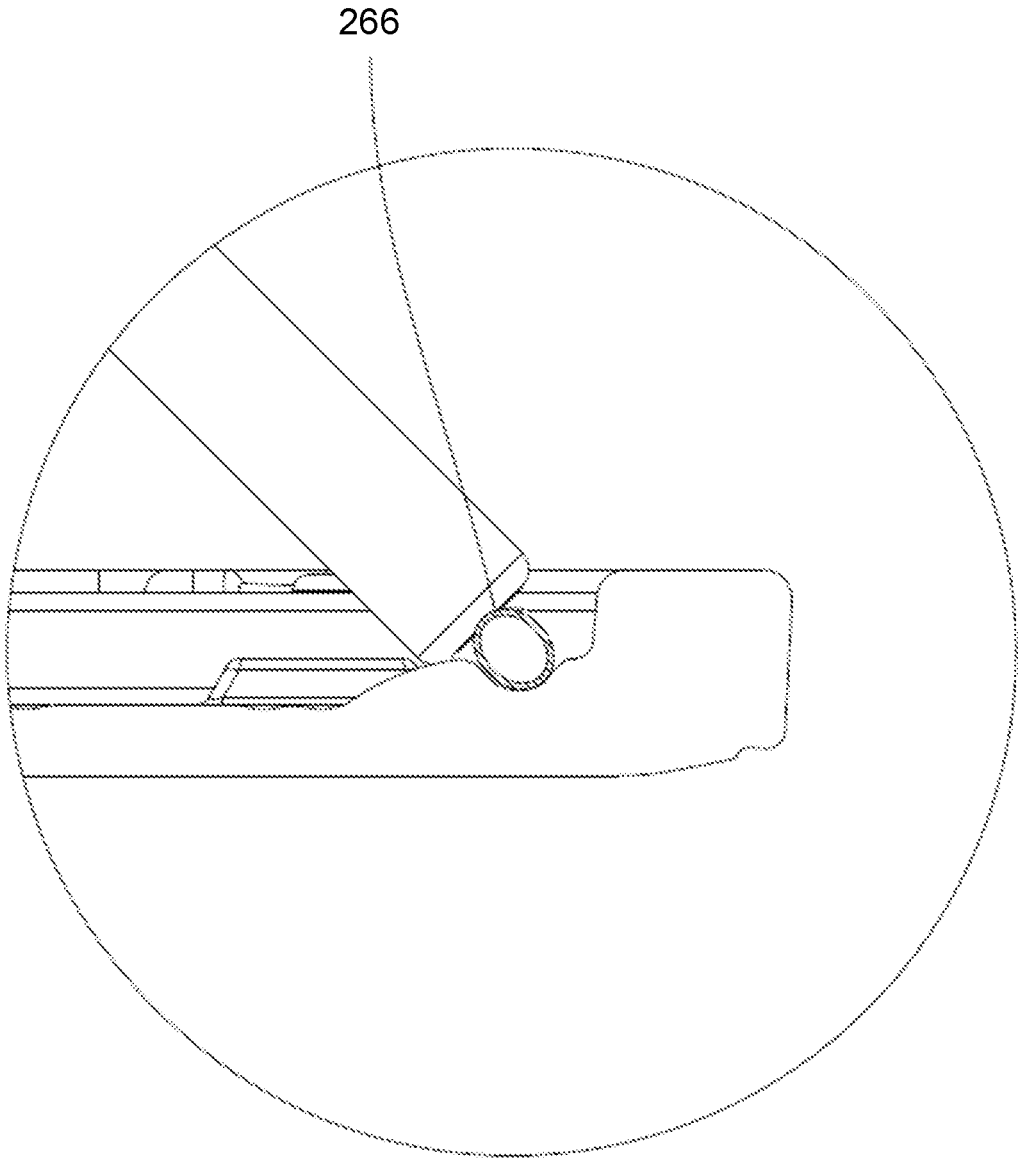
FIG. 6G is an enlarged view taken along circle G of FIG. 6F.
Figure 7A:
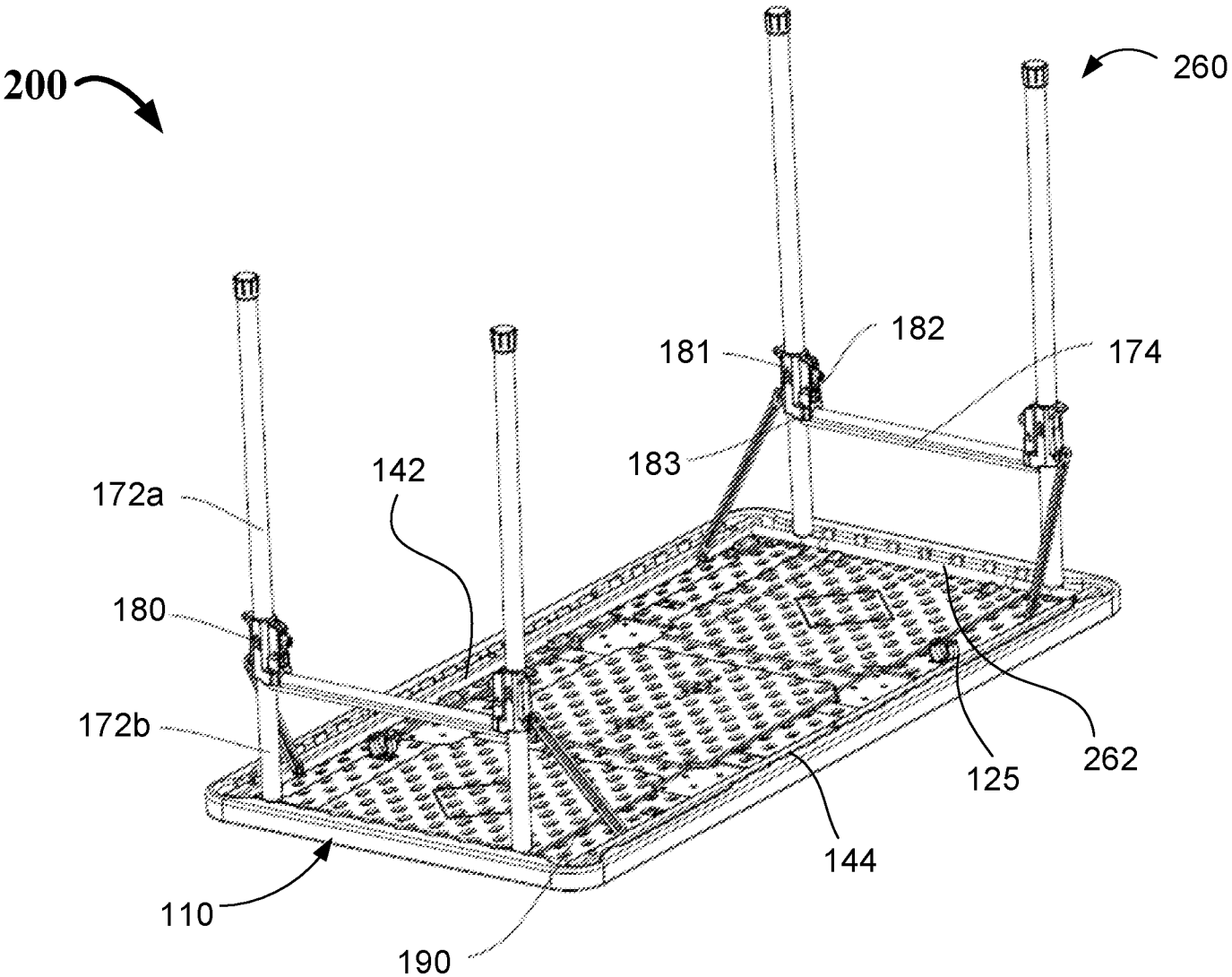
FIG. 7A is a bottom perspective view illustrating the exemplary table of FIG. 5A in an unfolded state in accordance with exemplary embodiments of the present disclosure.
Figure 7B:
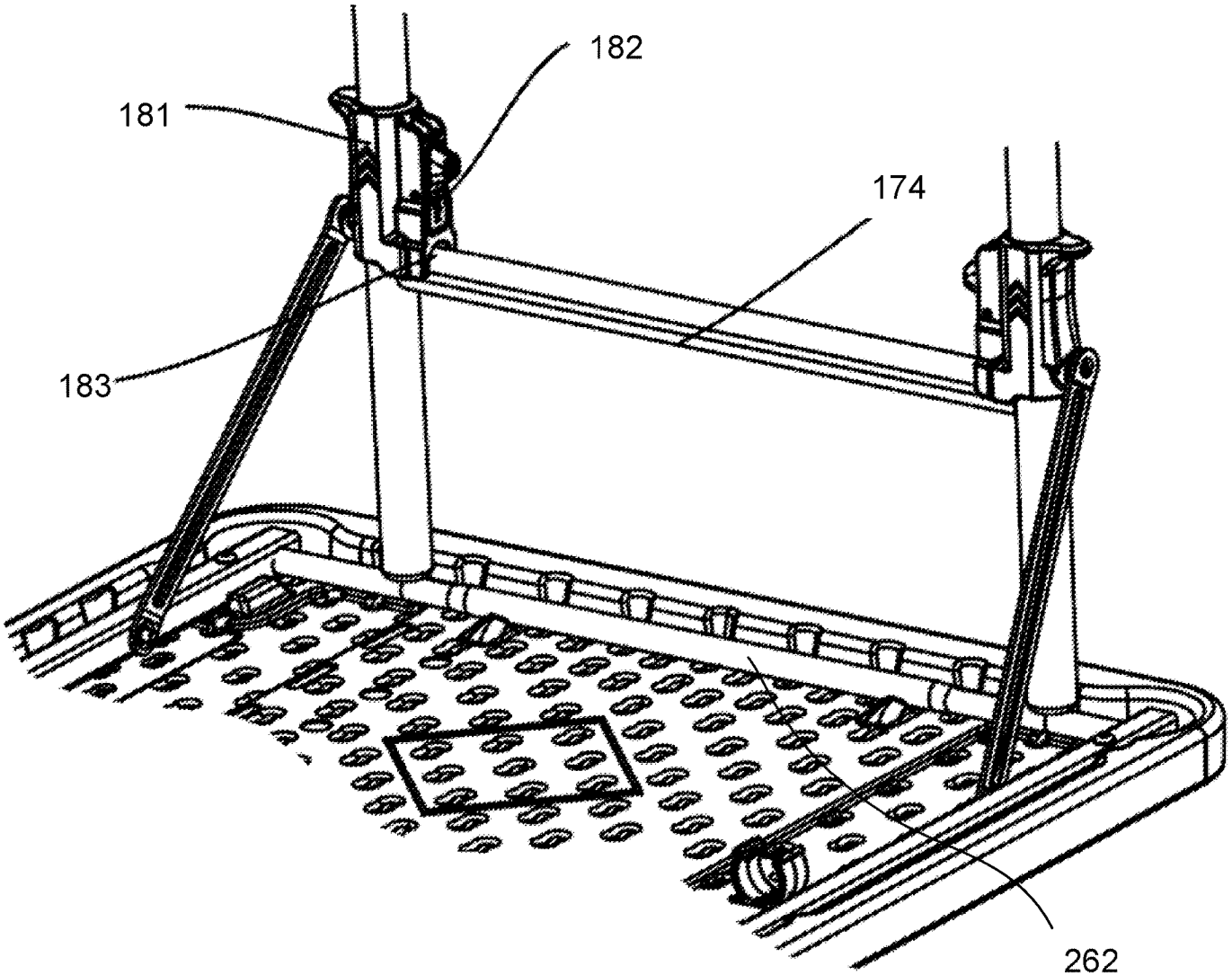
FIG. 7B is a partially enlarged view of FIG. 7A.
Figure 7C:
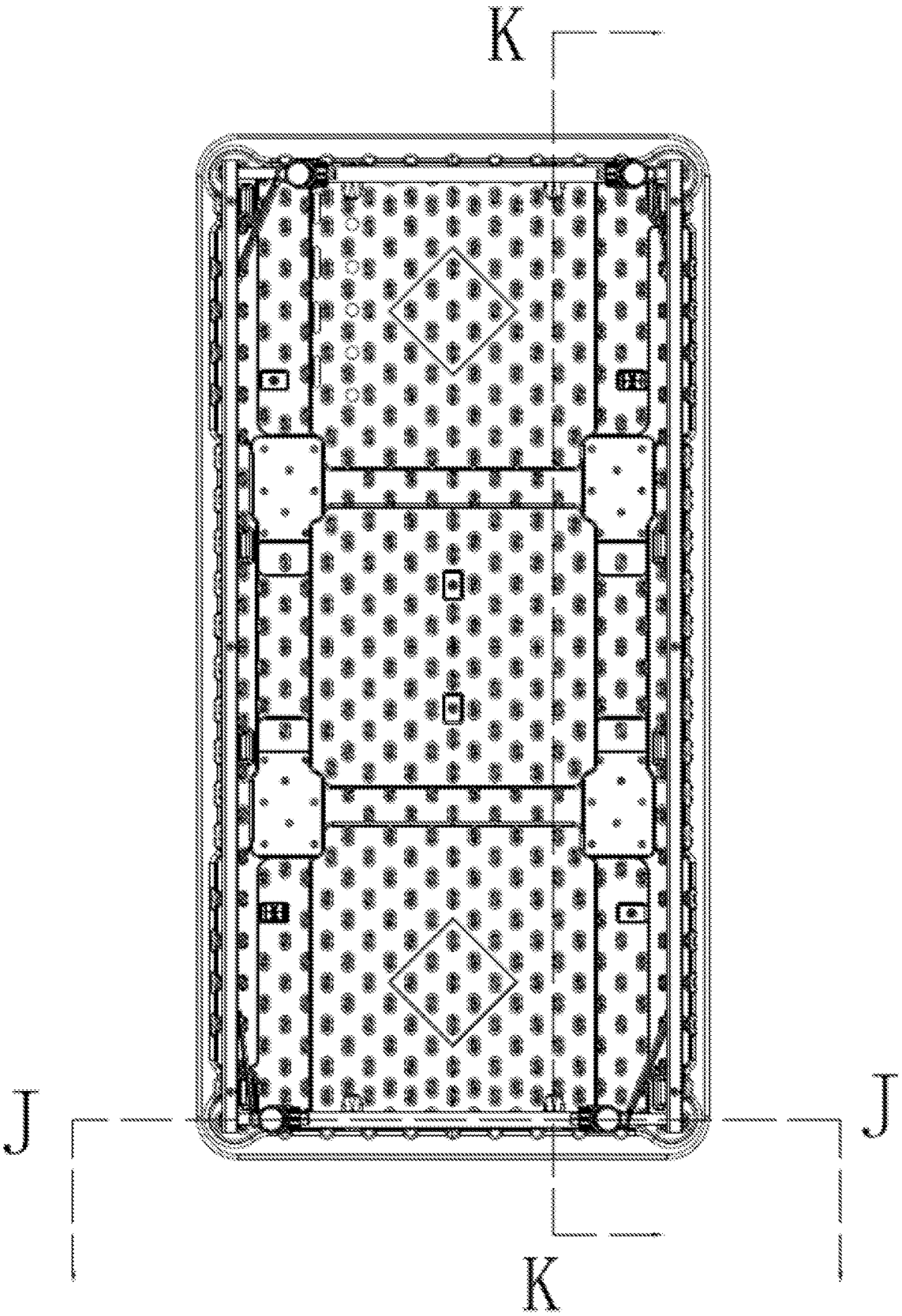
FIG. 7C is a bottom view illustrating an exemplary table in an intermediate state in accordance with exemplary embodiments of the present disclosure.
Figure 7D:
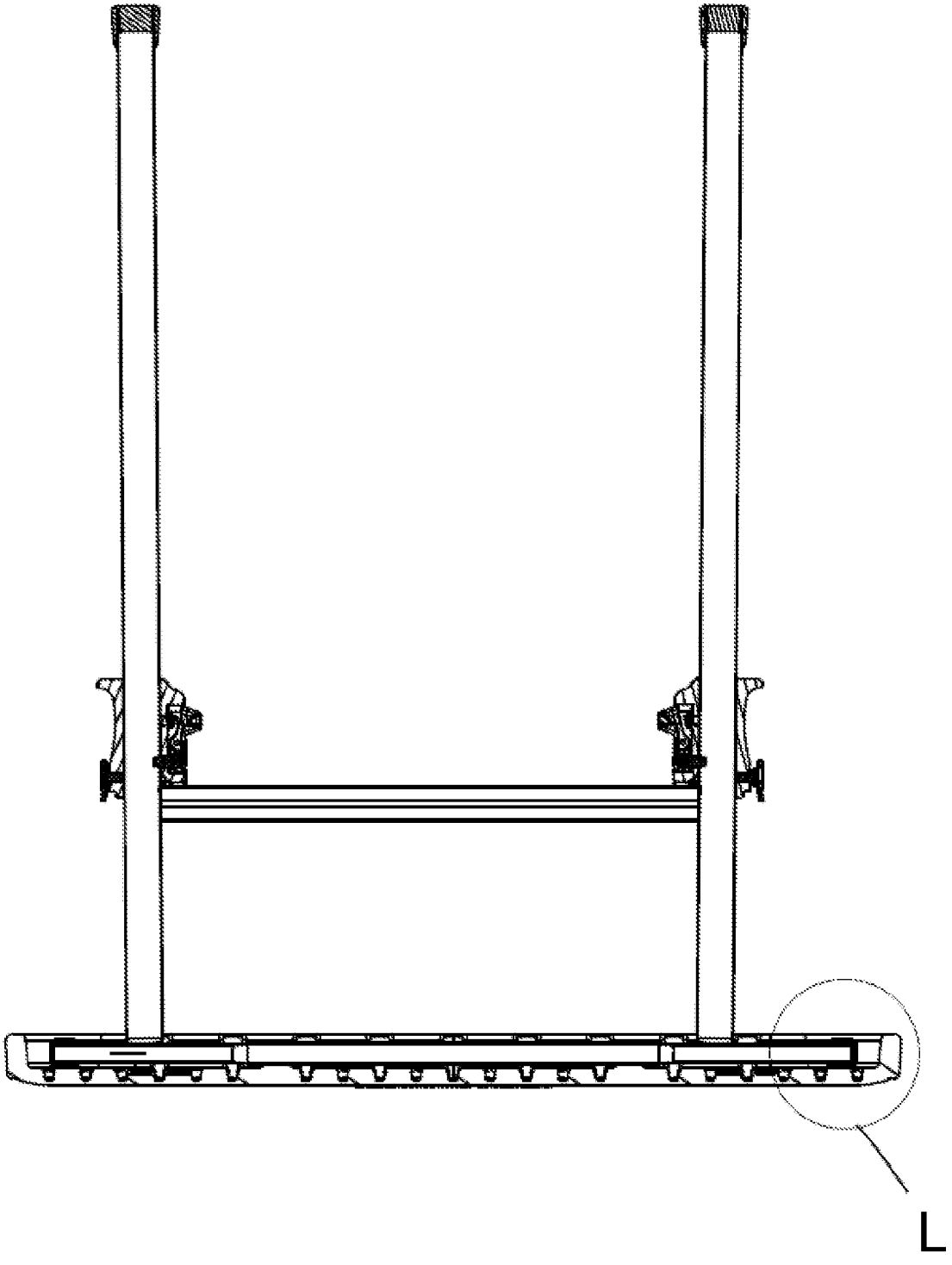
FIG. 7D is a cutout view taken along line J-J of FIG. 7C.
Figure 7E:
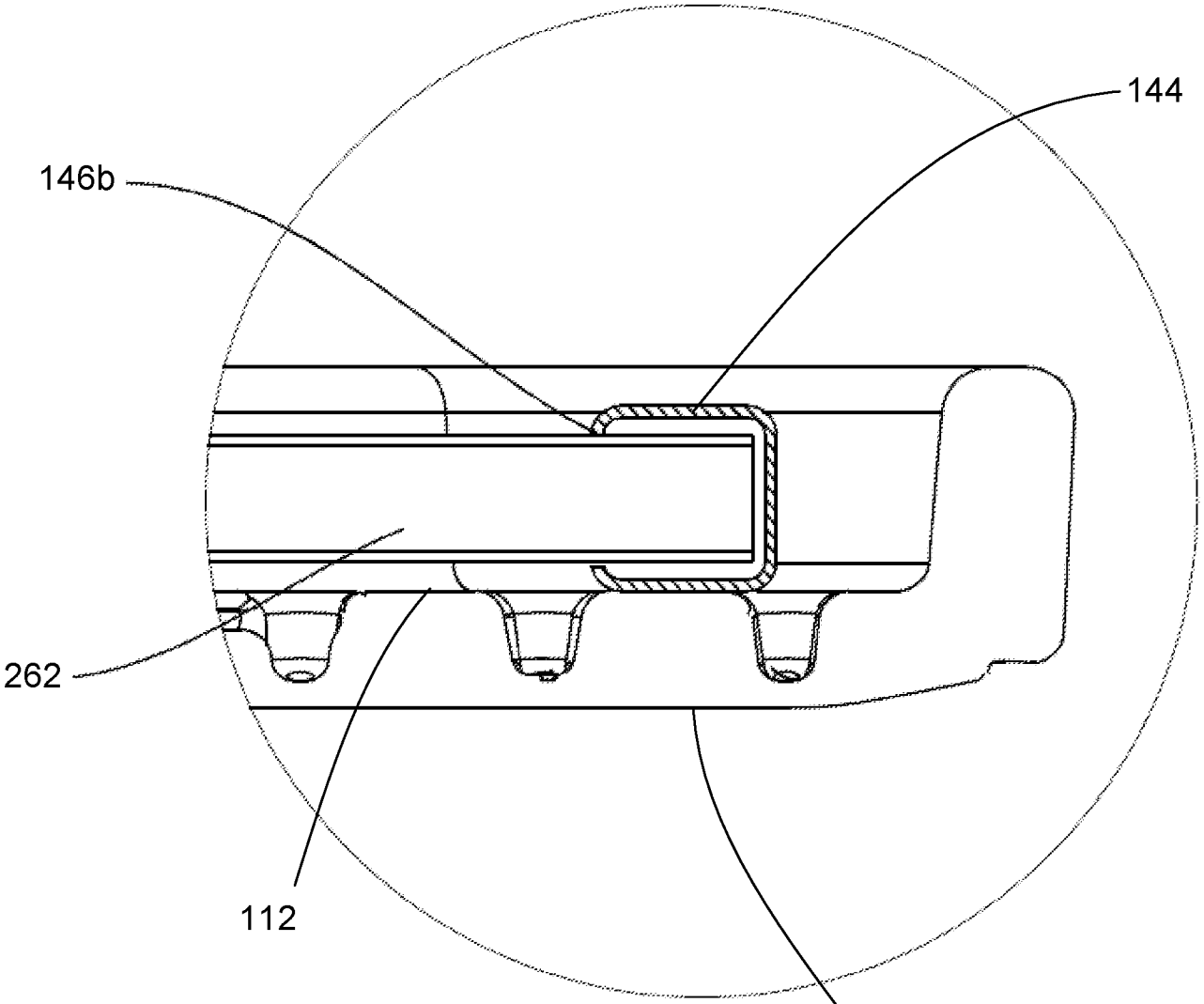
FIG. 7E is an enlarged view taken along circle L of FIG. 7D.
Figure 7F:
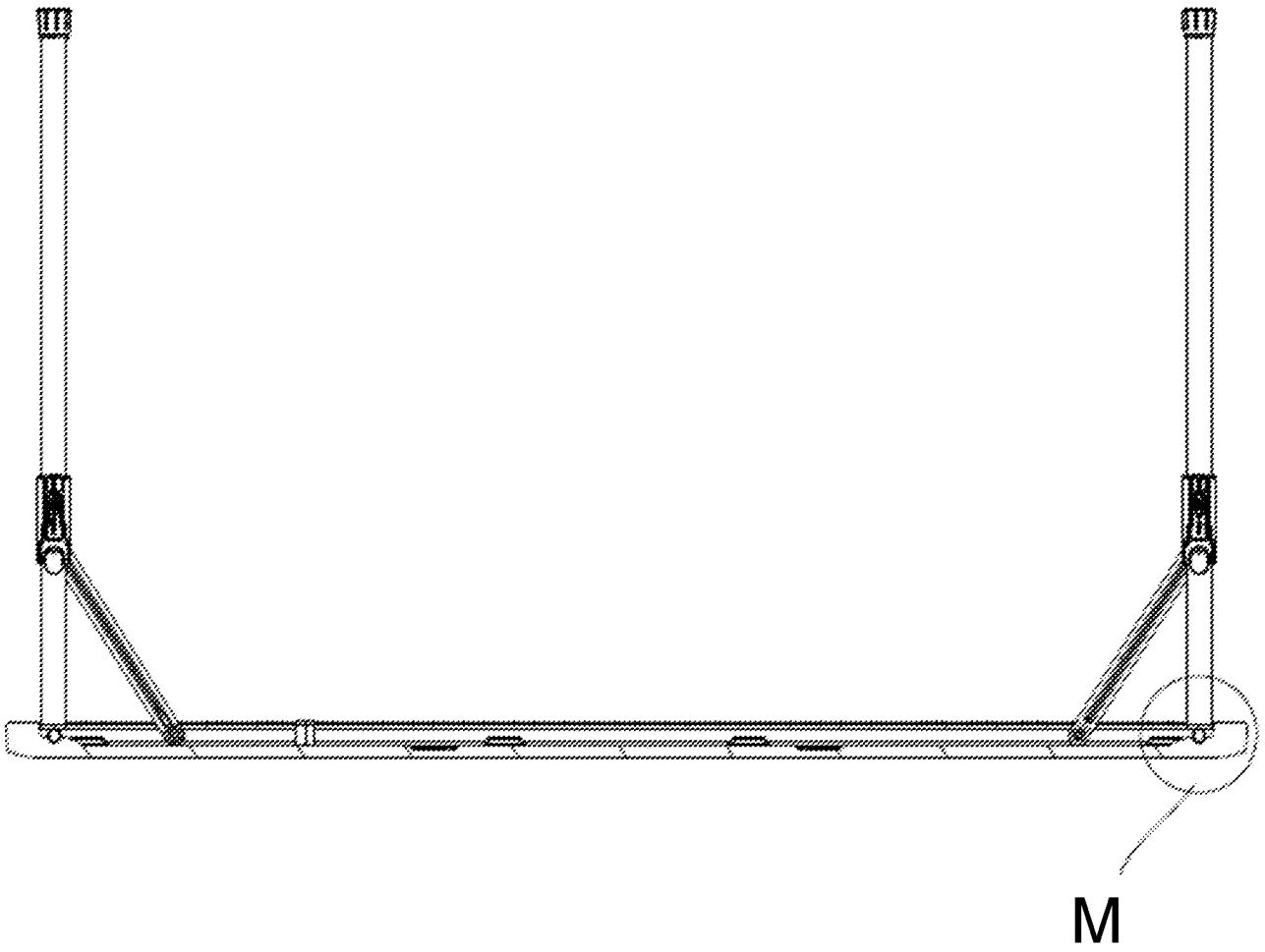
FIG. 7F is a cutout view taken along line K-K of FIG. 7C.
Figure 7G:
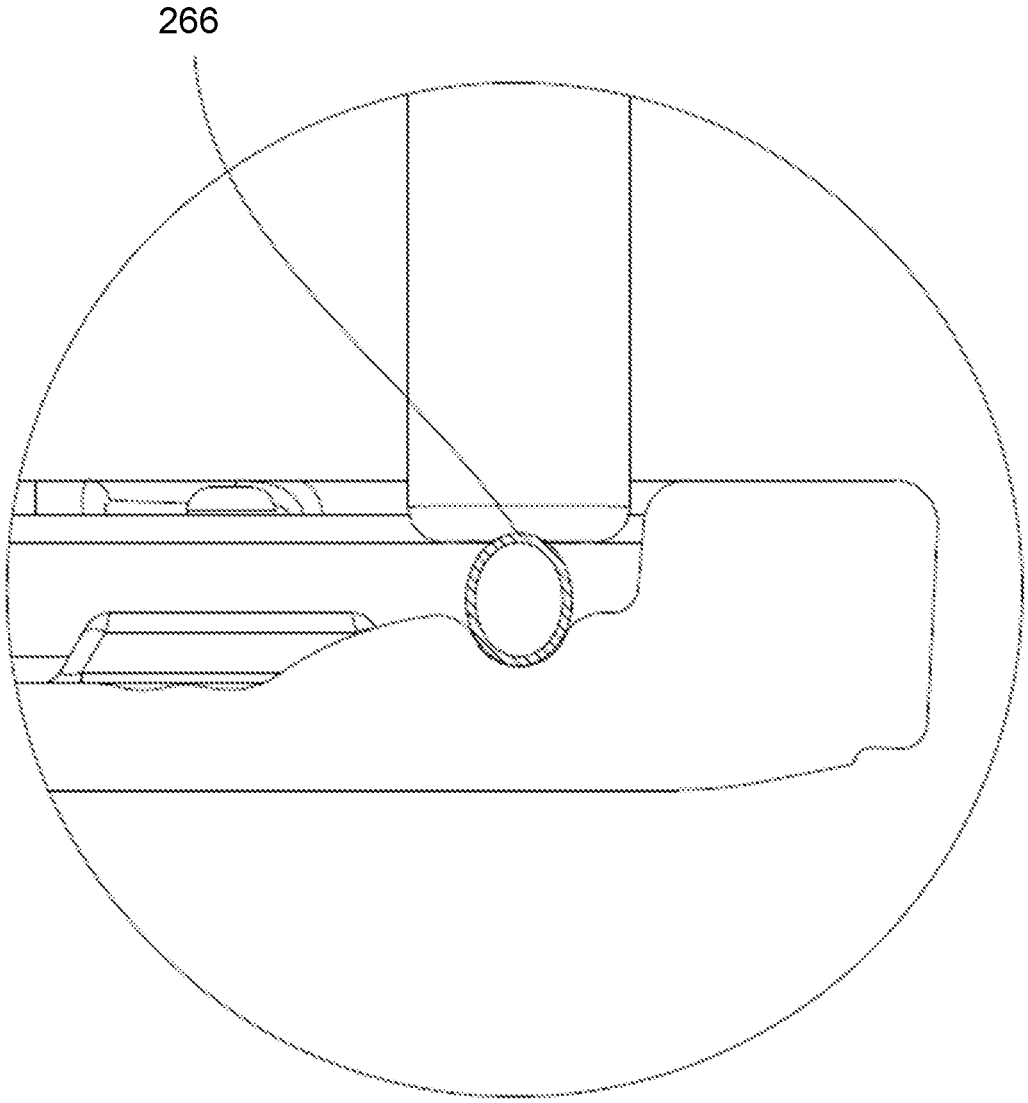
FIG. 7G is an enlarged view taken along circle M of FIG. 7F.

Referring in particular to FIGS. 5A-5B, 6A-6B and 7A-7B, linking member 262 includes a first end portion such as first end portion 263, a second end portion such as second end portion 264, and an engagement portion such as engagement portion 265 between the first and second end portions. First end portion 263 is rotatably coupled with opening 146 of the first mounting member and second end portion 264 is rotatably coupled with opening 146 of the second mounting member such that leg assembly 260 is rotatable respect to the table panel between a use position as illustrated in FIG. 7A (the table is in an unfolded state) and a storage position as illustrated in FIG. 5A (the table is in a folded state).

Engagement portion 265 is coupled with retainer 120. Unlike engagement portion 165 of linking member 160, engagement portion 265 does not have a circular cross-section. Instead, cross-section-wise, it has a first dimension generally larger than a second dimension. For instance, referring in particular to FIGS. 5F, 6F and 7G, cross-section-wise, engagement portion 265 of linking member 260 has first dimension 266 larger than second dimension 267. Engagement portion 265 can be made, for instance, by pressing or flattening a circular tube. In an exemplary embodiment, the engagement portion of the linking member has a substantially oval or oblong cross-section, and the first and second dimensions align with the longer and shorter axes of the oval or oblong cross-section. When the leg assembly is unfolded, the first dimension abuts against the retainer and thus pushes the first end portion toward far portion 146*b* of opening 146 of the first mounting member and the second end portion toward far portion 146*b* of opening 146 of the second mounting member. Accordingly, it reduces the gap between the first end portion and far portion 146*b* of opening 146 of the first mounting member and the gap between the second end portion and far portion 146*b* of opening 146 of the second mounting member.

In some exemplary embodiments, the abutting of the engagement portion (e.g., engagement portion 265) against the at least one first or second retainer (e.g., retainer 120) reduces the gap between the first or second end portion of the linking member (e.g., linking member 262) and the far portion of the opening of the first or second mounting member up to 2 millimeters, up to 3 millimeters, up to 4 millimeters, or up to 5 millimeters. In some exemplary embodiments, the abutting of the engagement portion against the retainer pushes the first end portion toward far portion 146*b* of opening 146 of the first mounting member and the second end portion toward far portion 146*b* of opening 146 of the second mounting member until the first end portion abuts against far portion 146*b* of opening 146 of the first mounting member and the second end portion abuts against far portion 146*b* of opening 146 of the second mounting member. As such, when the leg assembly is unfolded, the linking member forms interference or tighter fit with all of the first mounting member, the second mounting member and the table panel. This significantly reduces vibration when the table is in use.

Referring now to FIGS. 8A-8F, there is depicted exemplary table 300 in accordance with some embodiments of the present disclosure. Similar to table 100, table 300 includes a table panel such as table panel 110, a first mounting member such as first mounting member 342 and a second mounting member such as second mounting member 344. First mounting member 342 is coupled or integrally formed with the table panel adjacent to the third edge of the table panel and second mounting member 344 is coupled or integrally formed with the table panel adjacent to the third edge of the table panel. Table 300 further includes one or more leg assemblies, which can be the same as or different from each other. By way of example, table 300 is shown with two leg assemblies 360.

Figure 8A:
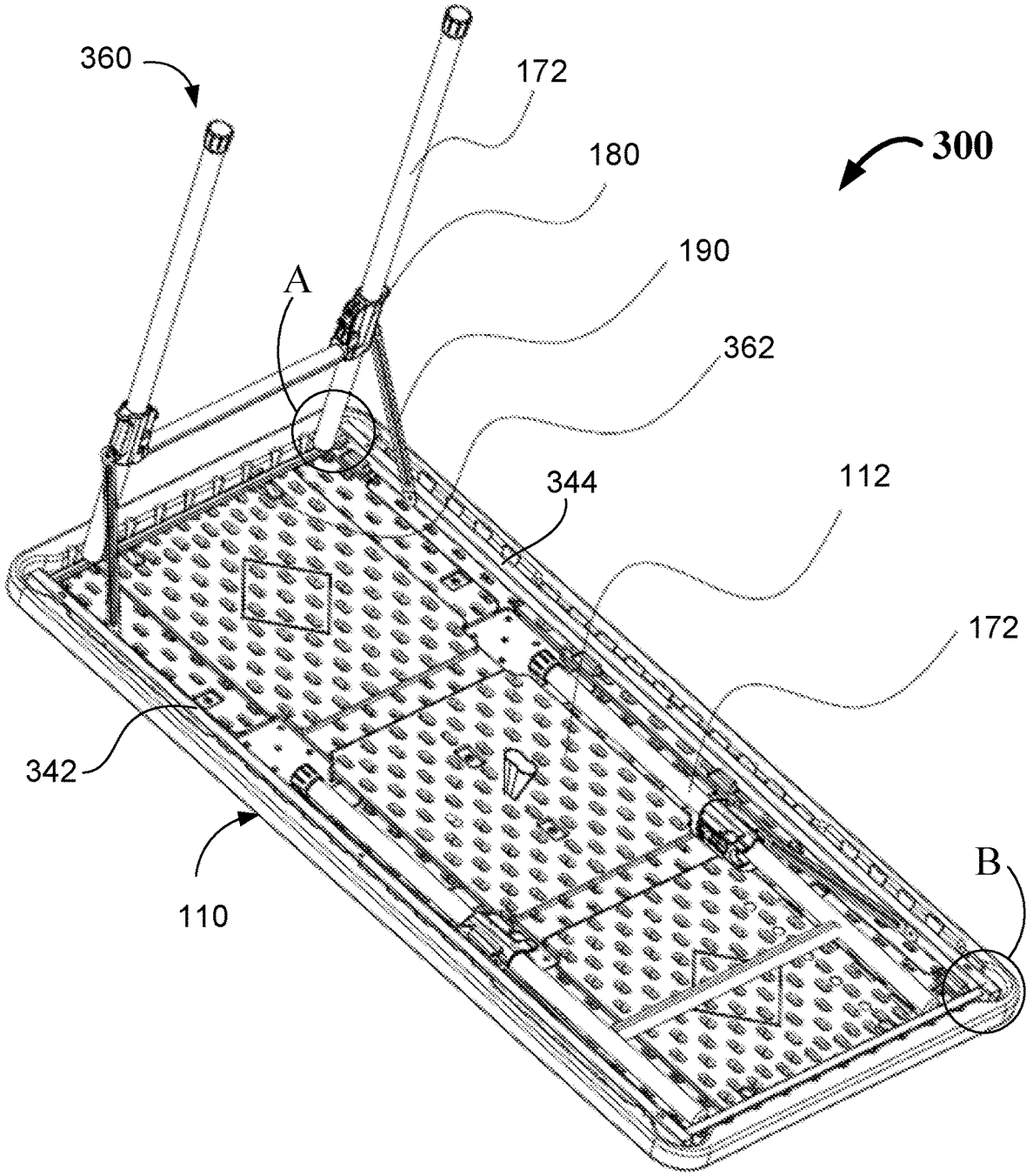
FIG. 8A is a bottom perspective view illustrating an exemplary table in an intermediate state in accordance with exemplary embodiments of the present disclosure.
Figure 8B:
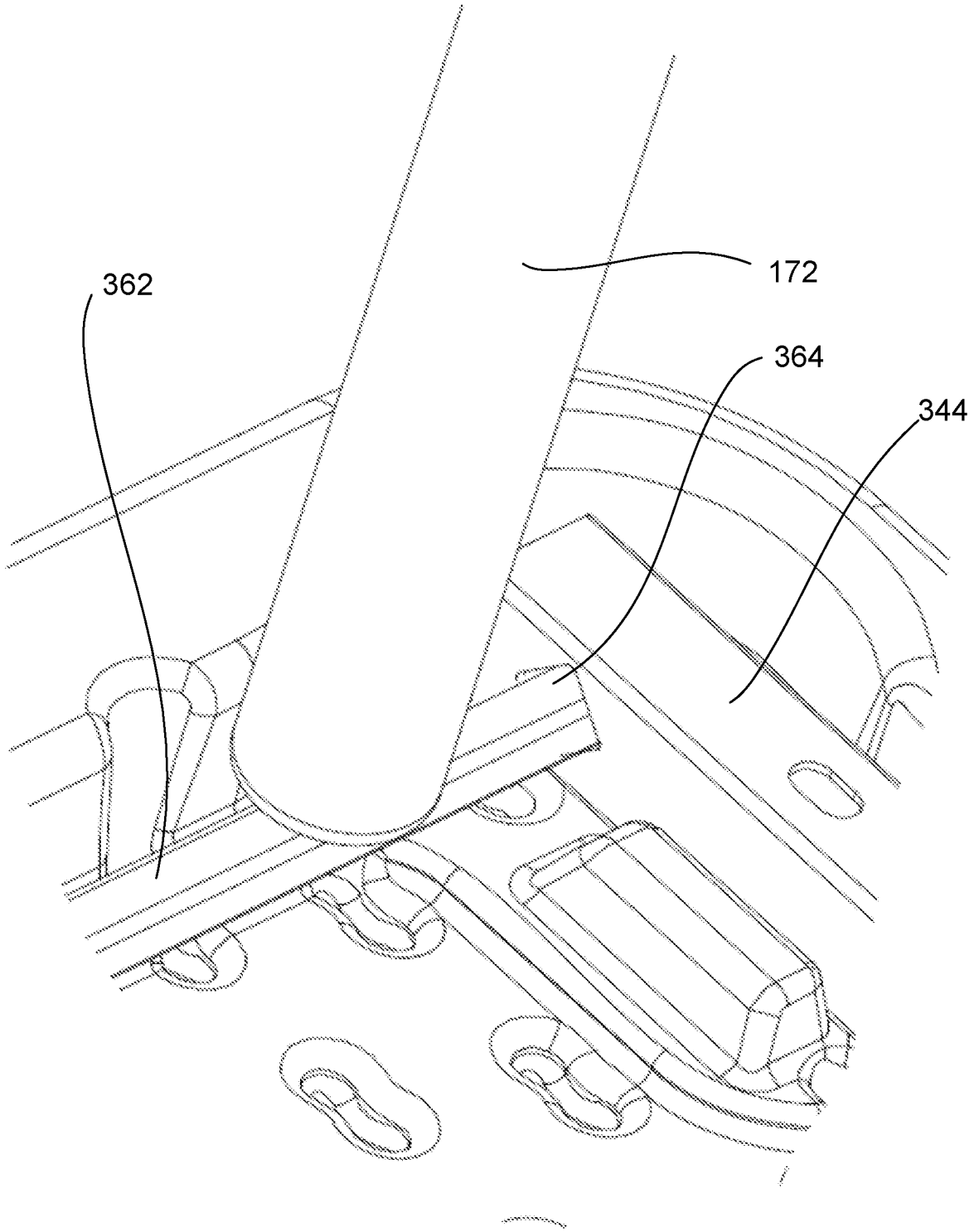
FIG. 8B is an enlarged view taken along circle B of FIG. 8A.
Figure 8C:
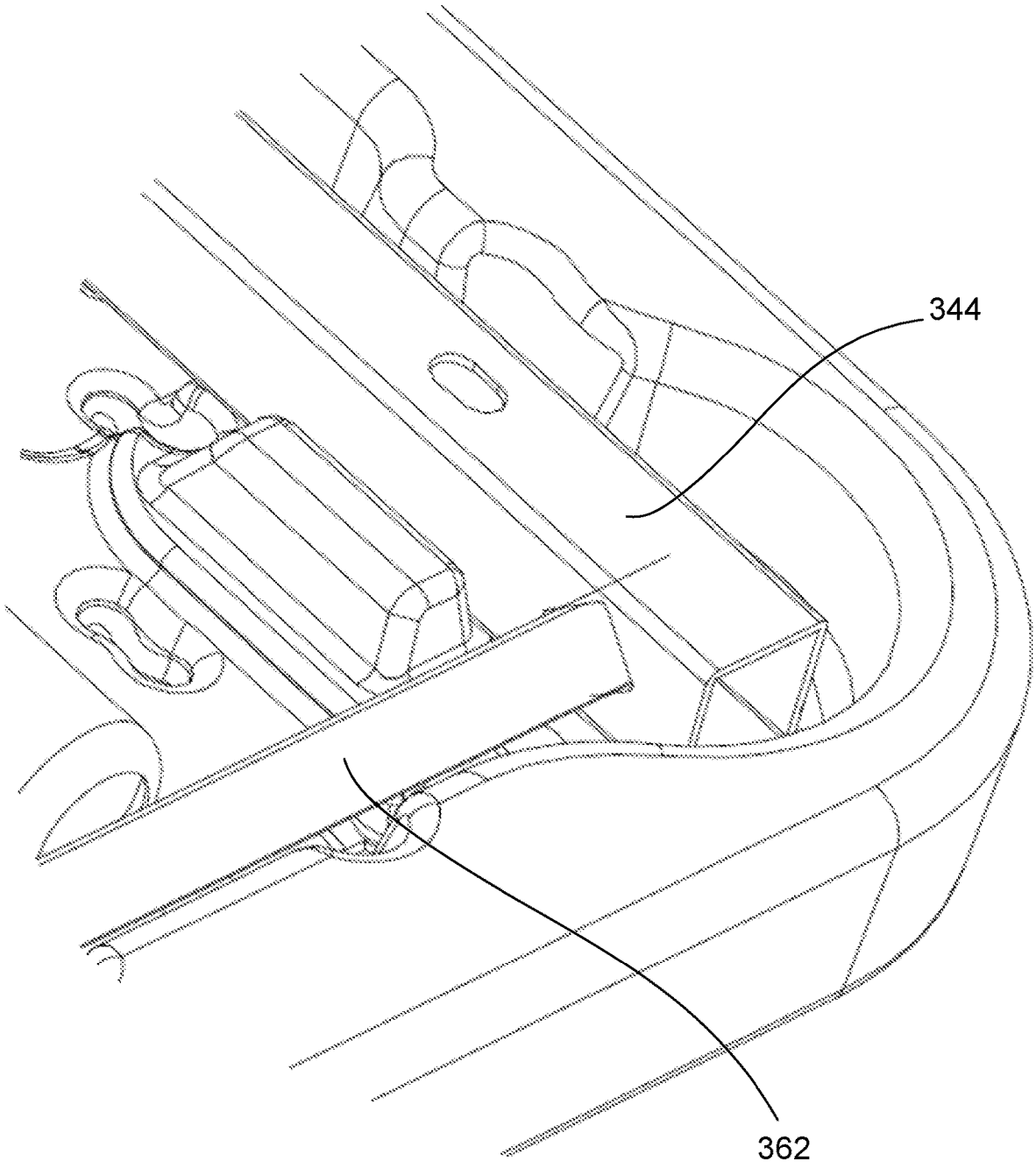
FIG. 8C is an enlarged view table along circle A of FIG. 8A.
Figure 8D:
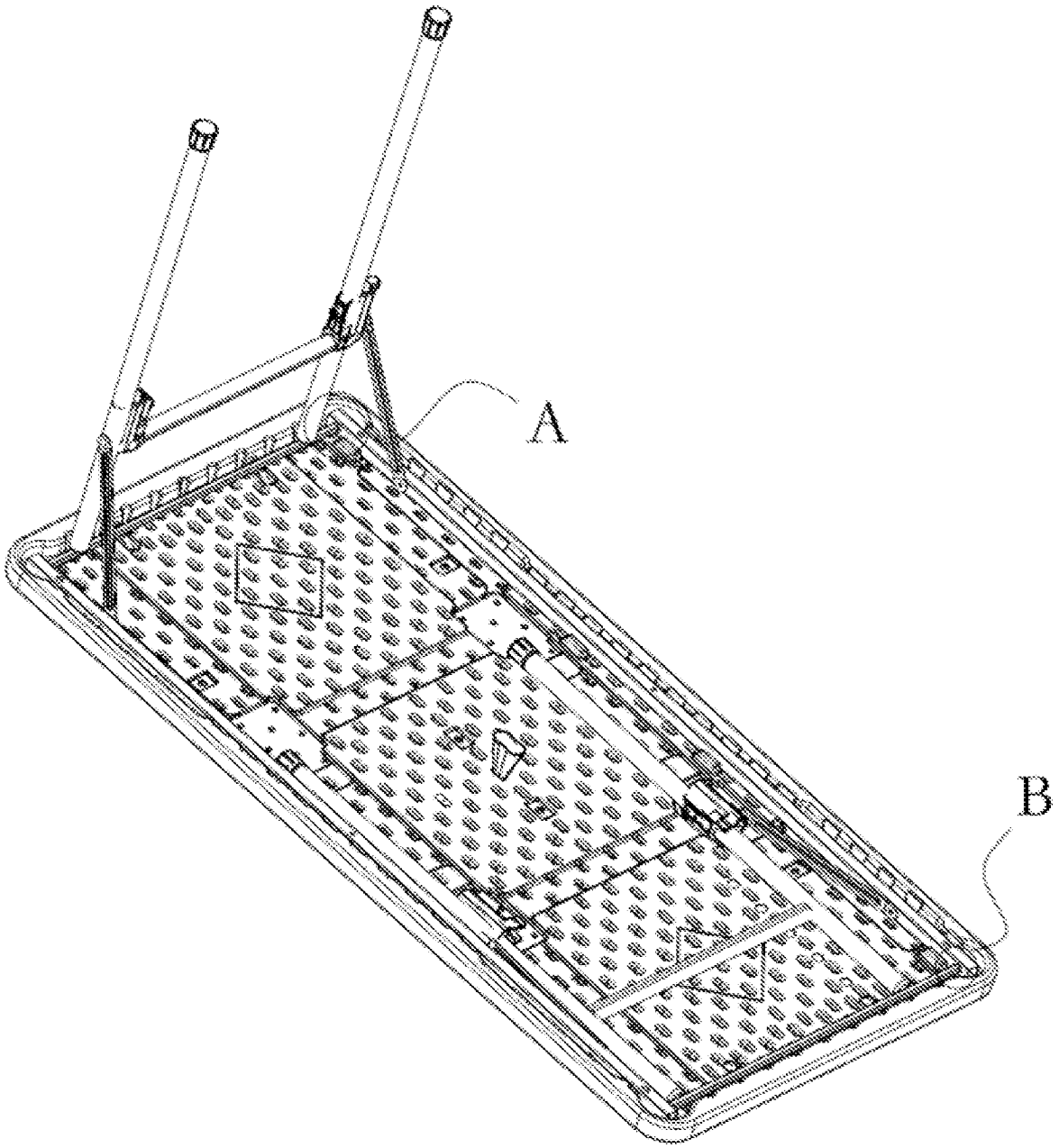
FIG. 8D is a partially disassembled view illustrating the exemplary table of FIG. 8A.
Figure 8E:
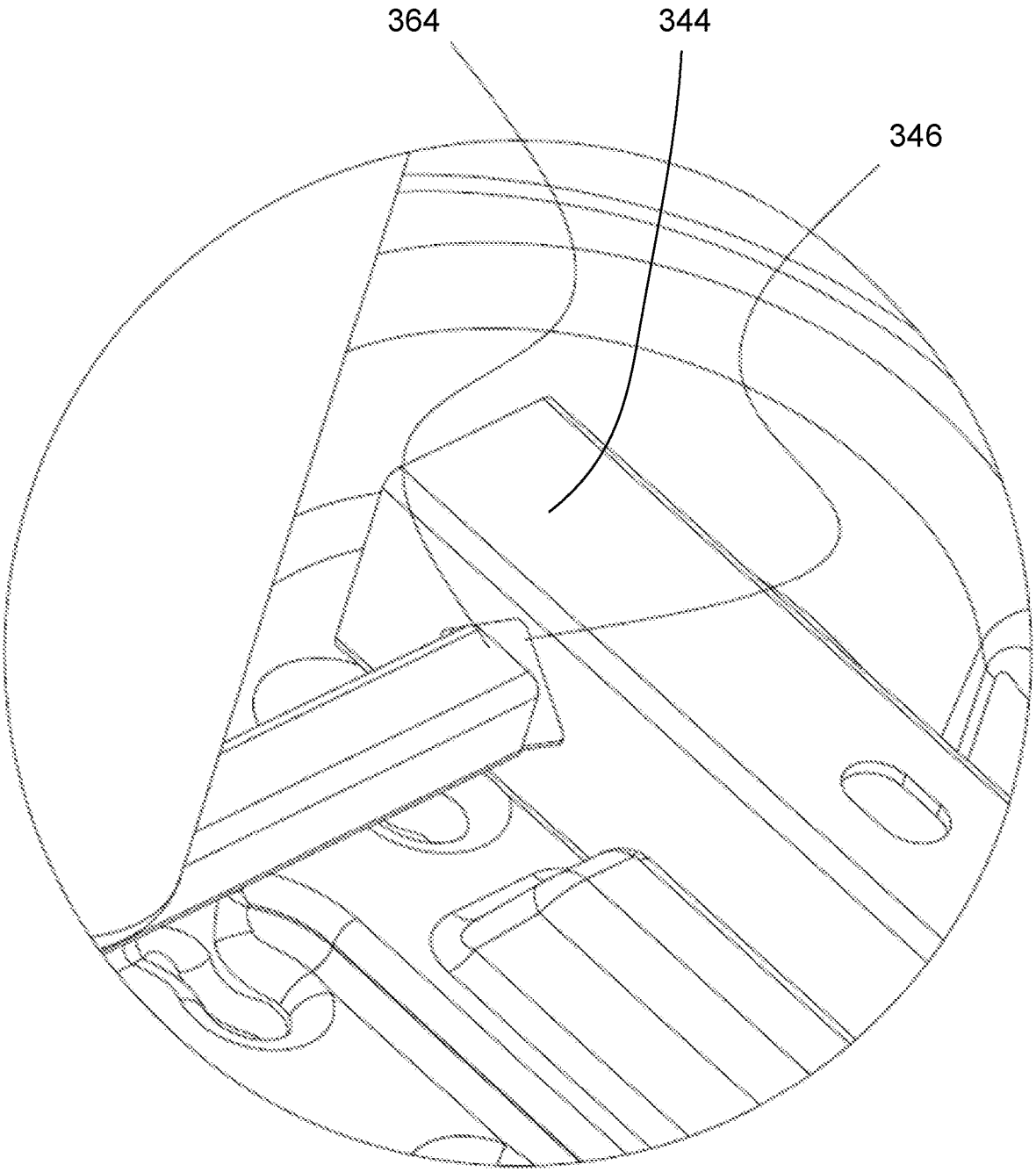
FIG. 8E is an enlarged view table along circle A of FIG. 8D.
Figure 8F:
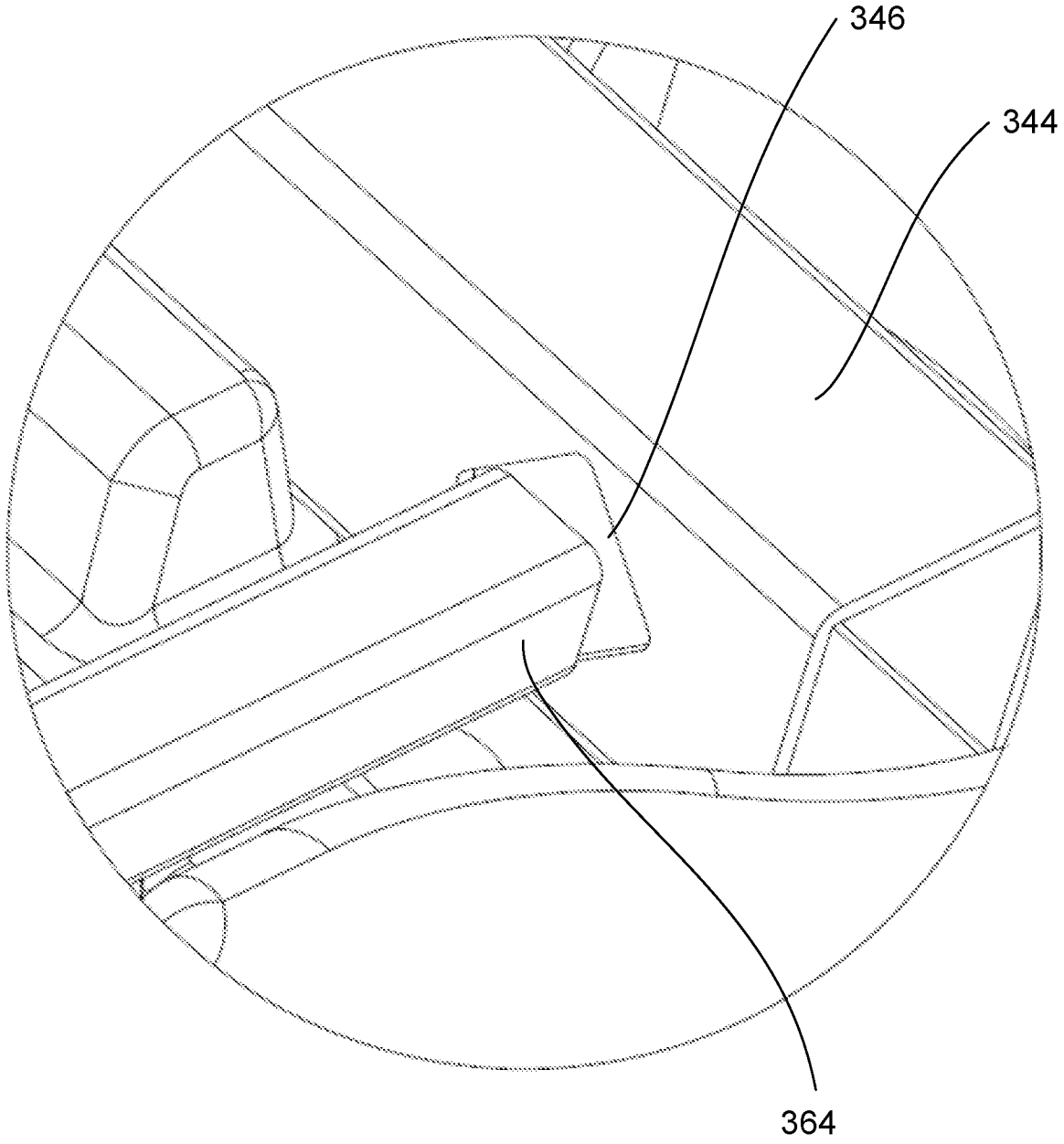
FIG. 8F is an enlarged view taken along circle B of FIG. 8D.

Like the first and second mounting members of table 100, each of the first and second mounting members of table 300 includes a first opening adjacent to the first edge of the table panel and a second opening adjacent to the second edge of the table panel. The first and second openings can be the same as or different from each other. By way of example, the first and second mounting members of table 300 are shown to be substantially the same with opening 346 adjacent to each of first edge 113 and second edge 114 of the table panel. In some exemplary embodiments, opening 346 has a polygonal shape with a plurality of edges. For instance, in an exemplary embodiment, opening 346 has a diamond shape with four edges. In some exemplary embodiments, opening 346 has a first diagonal axis substantially parallel to a length direction of the first or second mounting member, and a second diagonal axis substantially perpendicular to the first diagonal axis as illustrated in FIGS. 8E and 8F.

Leg assembly 360 includes a linking member such as linking member 362 having first and second end portions such as end portion 364. The first end portion is rotatably coupled with opening 346 of the first mounting member and the second end portion is rotatably coupled with opening 346 of the second mounting member such that the first or second leg assembly is foldable with respect to the table panel. In an exemplary embodiment, linking member 362 is substantially the same as linking member 162 (e.g., having a substantially circular cross-section) or linking member 262 (e.g., having a flattened engagement portion). In another exemplary embodiment, linking member 362 having a polygonal cross-section (e.g., square) or the like.

When the leg assembly is unfolded, the first end portion of the linking member abuts at least two edges of opening 346 of the first mounting member and the second end portion of the linking member abuts at least two edges of opening 346 of the second mounting member. The abutting of the linking member against at least two edges of opening 346 forms interference fit between the linking member and the first and second mounting members, thereby reducing vibration when the table is in use. In some exemplary embodiments, as illustrated in FIGS. 8A and 8C, when the leg assembly is folded onto the table panel, the first end portion of the linking member also abuts at least two edges of opening 346 of the first mounting member and the second end portion of the linking member abuts at least two edges of opening 346 of the second mounting member. As such, it prevents accidental unfolding of the leg assemblies.

Figure 9A:
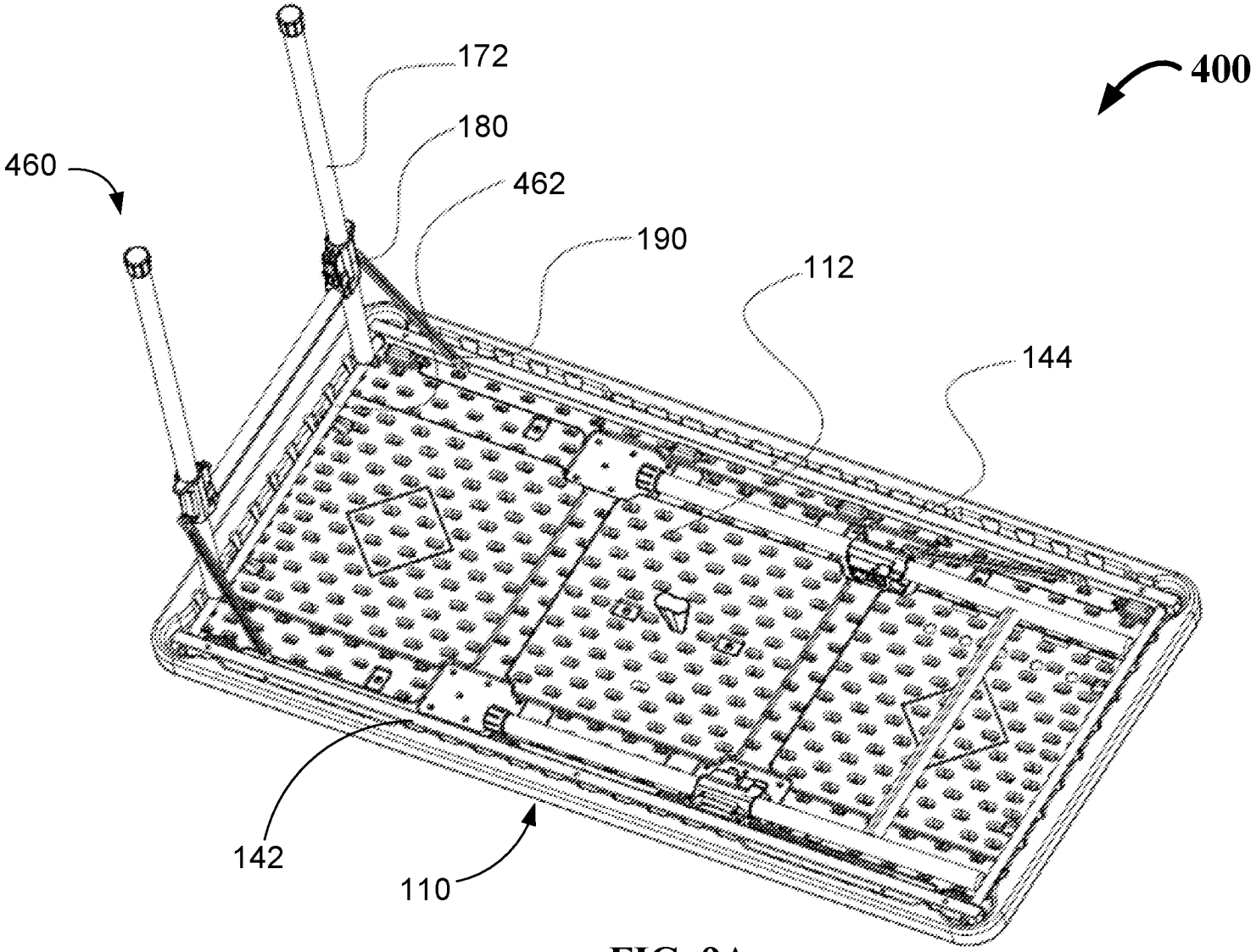
FIG. 9A is a bottom perspective view illustrating an exemplary table in an intermediate state in accordance with exemplary embodiments of the present disclosure.
Figure 9B:
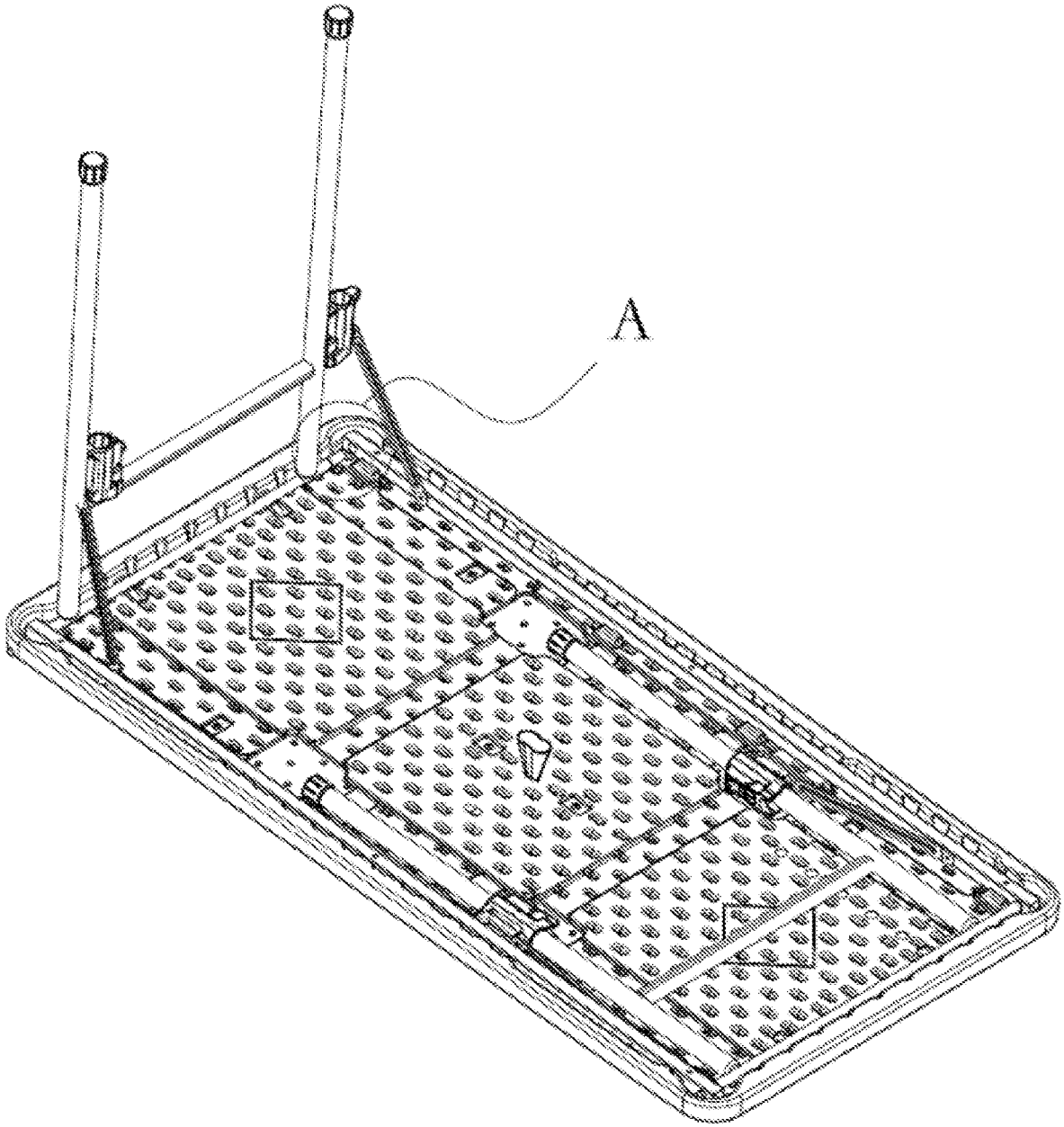
FIG. 9B is a partially disassembled view illustrating the exemplary table of FIG. 9A.
Figure 9C:
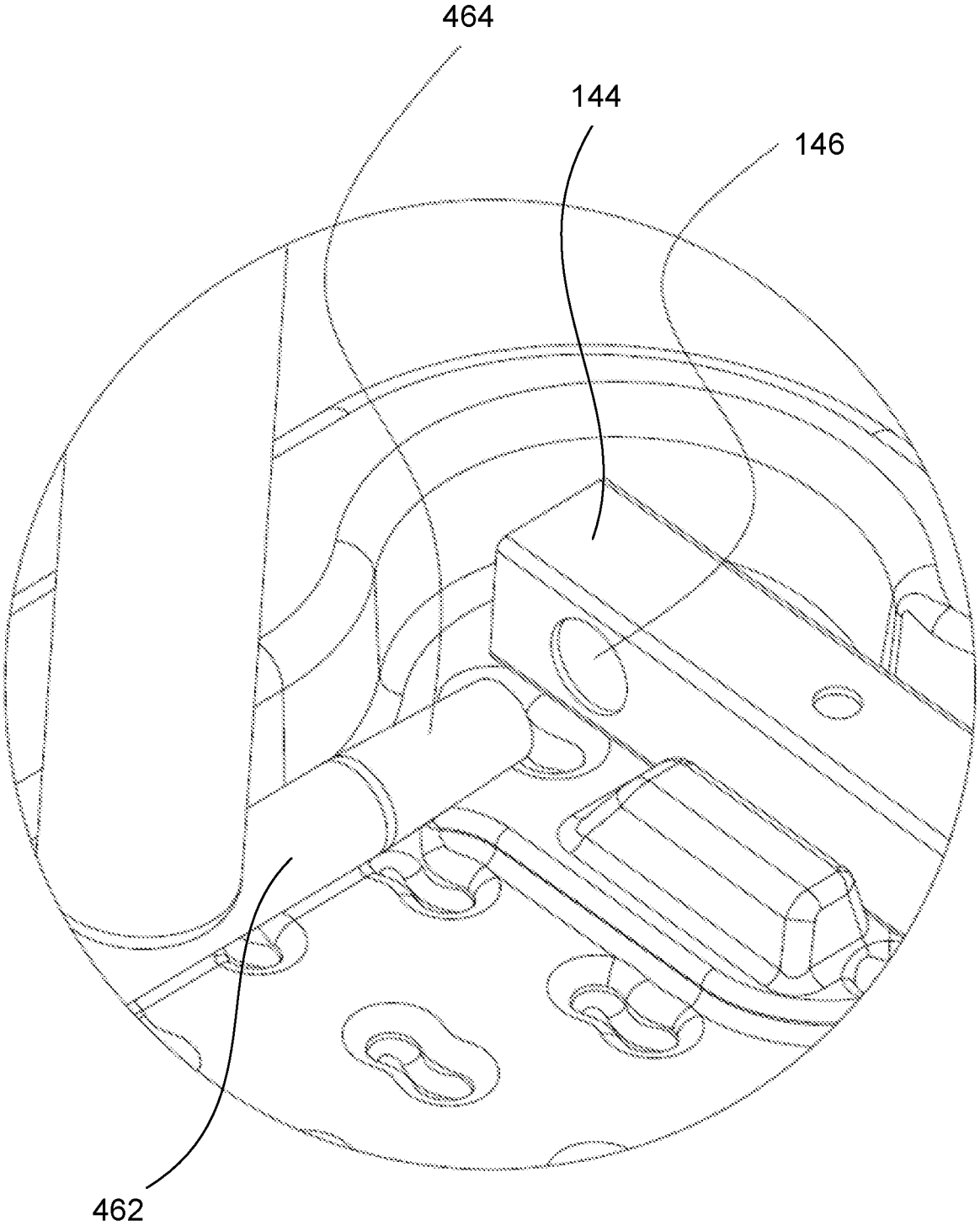
FIG. 9C is an enlarged view table along circle A of FIG. 9B.

Referring now to FIGS. 9A-9C, there is depicted exemplary table 400 in accordance with some embodiments of the present disclosure. Similar to table 100, table 400 includes a table panel such as table panel 110, a first mounting member such as first mounting member 142 and a second mounting member such as second mounting member 144. Table 400 further includes one or more leg assemblies, which can be the same as or different from each other. By way of example, table 400 is shown with two leg assemblies 460.

Leg assembly 460 includes a linking member such as linking member 462 with first and second end portions such as end portion 464. The first end portion is rotatably coupled with opening 146 of the first mounting member and the second end portion is rotatably coupled with opening 146 of the second mounting member such that the leg assembly is foldable with respect to the table panel.

In some exemplary embodiments, each of the first and second end portions of linking member 462 is tapered (e.g., the nominal diameter of the cross-section reduces toward the end). The tapered first end portion facilitates easy insertion into the opening of the first mounting member and, once inserted, forms interference fit with the opening of the first mounting member. Similarly, the tapered second end portion facilitates easy insertion into the opening of the second mounting member and, once inserted, forms interference fit with the opening of the second mounting member. As such, it reduces vibration when the table is in use. For instance, in an exemplary embodiment, opening 146 has a substantially circular shape, and each of the first and second end portions of linking member 462 has a substantially conic or truncated conic shape. While the smaller end tip allows easy insertion into the opening, the gradually increased end portion forms relatively tighter fit with the opening, thereby reducing vibration when the table is in use. The relatively tighter fit also prevents accidental unfolding of the leg assemblies.

The terminology used herein is for the purpose of describing particular implementations only and is not intended to be limiting of the claims. As used in the description of the implementations and the appended claims, the singular forms "a", "an" and "the" are intended to include the plural forms as well, unless the context clearly indicates otherwise. It will be understood that the terms "top" or "bottom", "lower" or "upper", and etc. are used to describe features of the exemplary embodiments with reference to the positions of such features as displayed in the figures. It will be understood that, although the terms "first," "second," etc.

may be used herein to describe various elements, these elements should not be limited by these terms. These terms are only used to distinguish one element from another. For example, a first bar could be termed a second bar, and, similarly, a second bar could be termed a first bar, without changing the meaning of the description, so long as all occurrences of the "first bar" are renamed consistently and all occurrences of the "second bar" are renamed consistently.

What is claimed is:

1. A table comprising:

a table panel comprising:

first and second surfaces;

first, second, third and fourth edges; and a plurality of retainers integrally formed with the second surface and protruding away from the second surface, wherein at least one first retainer is disposed adjacent to the first edge and at least one second retainer is disposed adjacent to the second edge, wherein the at least one first retainer and the at least one second retainer are integrally formed with the second surface during a blow molding process;

first and second mounting members, wherein the first mounting member is disposed adjacent to the third edge of the table panel, the second mounting member is disposed adjacent to the fourth edge of the table panel, and each of the first and second mounting members comprises a first opening adjacent to the first edge of the table panel and a second opening adjacent to the second edge of the table panel; and first and second leg assemblies, each comprising a linking member disposed adjacent to the first or second edge of the table panel, wherein the linking member comprises:

a first end portion rotatably coupled with the first or second opening of the first mounting member and a second end portion rotatably coupled with the first or second opening of the second mounting member such that the first or second leg assembly is foldable with respect to the table panel; and an engagement portion abutting against the at least one first or second retainer when the first or second leg assembly is unfolded, wherein the abutting of the engagement portion against the at least one first or second retainer pushes the first end portion toward a far portion of the first or second opening of the first mounting member and the second end portion toward a far portion of the first or second opening of the second mounting member, thereby reducing a gap between the first or second end portion of the linking member and the far portion of the first or second opening of the first or second mounting member and thus reducing vibration when the table is in use.

2. The table of claim 1, wherein the abutting of the engagement portion against the at least one first or second retainer pushes the first end portion toward the far portion of the first or second opening of the first mounting member and the second end portion toward the far portion of the first or second opening of the second mounting member until the first end portion abuts against the far portion of the first or second opening of the first mounting member and the second end portion abuts against the far portion of the first or second opening of the second mounting member, thereby forming interference fit between the first or second end portion of the linking member and the far portion of the first or second opening of the first or second mounting member.

3. The table of claim 1, wherein the gap is reduced up to 5 millimeters.

4. The table of claim 1, wherein each of the first and second openings has a substantially circular shape.

5. The table of claim 1, wherein the engagement portion of the linking member has a substantially circular cross-section.

6. The table of claim 1, wherein cross-section-wise, the engagement portion of the linking member has a first dimension larger than a second dimension, and the first dimension abuts the at least one first or second retainer when the first or second leg assembly is unfolded.

7. The table of claim 6, wherein the engagement portion of the linking member has a substantially oval or oblong cross-section.

8. The table of claim 1, wherein:

each of the at least one first retainer and the at least one second retainer is formed with a recess toward the second surface of the table panel to receive, cross-section-wise, at least a portion of the engagement portion of the linking member.

9. The table of claim 8, wherein the recess has a bottom protruding away from the second surface of the table panel.

10. The table of claim 8, wherein cross-section-wise, the engagement portion of the linking member has a first dimension larger than a second dimension, and the first dimension abuts the recess when the first or second leg assembly is unfolded.

11. The table of claim 10, wherein the engagement portion of the linking member has a substantially oval or oblong cross-section.

12. The table of claim 1, wherein each of the first and second leg assemblies is adjustable in length.

13. The table of claim 1, wherein the first or second leg assembly further comprises:

first and second legs, each having an upper end portion fixedly coupled with the link member;

first and second sliders, wherein the first slider is coupled with the first leg and slidable along a length direction of the first leg, and the second slider is coupled with the second leg and slidable along a length direction of the second leg; and first and second supporting members, wherein the first supporting member has an end portion pivotally connected with the first slider and another end portion pivotally connected with the first mounting member, and the second supporting member has an end portion pivotally connected with the second slider and another end portion pivotally connected with the second mounting member.

14. The table of claim 13, wherein the first or second leg assembly further comprises a leg connecting member disposed between the first and second legs and connected with the first and second legs; and each of the first and second sliders comprises a notch to couple with the leg connecting member when the first or second leg assembly is unfolded.

15. The table of claim 13, wherein the plurality of retainers further comprises:

at least one third retainer configured to receive cross-section-wise at least a portion of the first or second leg of the first leg assembly when the first leg assembly is folded; and at least one fourth retainer configured to receive cross-section-wise at least a portion of the first or second leg of the second leg assembly when the second leg assembly is folded.

16. The table of claim 1, wherein a first retainer in the at least one first retainer is aligned with a second retainer in the at least one second retainer along a length direction of the first or second mounting member.

17. A supporting frame comprising:

first and second mounting members, each comprising a first opening at or adjacent to a first end portion thereof and a second opening at or adjacent to a second end portion thereof, wherein each of the first and second openings has a polygonal shape with a plurality of edges; and first and second leg assembles, each comprising a linking member, wherein the linking member comprises a first end portion rotatably coupled with the first or second opening of the first mounting member and a second end portion rotatably coupled with the first or second opening of the second mounting member such that the first or second leg assembly is foldable with respect to the table panel, wherein when the first or second leg assembly is unfolded, the first end portion of the linking member abuts at least two edges of the first or second opening of the first mounting member and the second end portion of the linking member abuts at least two edges of the first or second opening of the second mounting member, thereby forming interference fit to reduce vibration when the table is in use, and wherein each of the first and second openings has a diamond shape.

18. A table comprising: a supporting frame of claim 17, and a table panel coupled with the supporting frame.

19. A supporting frame comprising:

first and second mounting members, each comprising a first opening at or adjacent to a first end portion thereof and a second opening at or adjacent to a second end portion thereof, wherein each of the first and second openings has a polygonal shape with a plurality of edges; and first and second leg assembles, each comprising a linking member, wherein the linking member comprises a first end portion rotatably coupled with the first or second opening of the first mounting member and a second end portion rotatably coupled with the first or second opening of the second mounting member such that the first or second leg assembly is foldable with respect to the table panel, wherein when the first or second leg assembly is unfolded, the first end portion of the linking member abuts at least two edges of the first or second opening of the first mounting member and the second end portion of the linking member abuts at least two edges of the first or second opening of the second mounting member, thereby forming interference fit to reduce vibration when the table is in use, and wherein each of the first and second openings has a first diagonal axis substantially parallel to a length direction of the first or second mounting member, and a second diagonal axis substantially perpendicular to the first diagonal axis.

20. A table comprising: a supporting frame of claim 19, and a table panel coupled with the supporting frame.

* * * * *